US005284522A

United States Patent [19]

Kobayashi et al.

[11] Patent Number: 5,284,522

[45] Date of Patent: Feb. 8, 1994

[54] SELF-RUNNING CLEANING CONTROL METHOD

[75] Inventors: Yasumichi Kobayashi, Toyonaka; Hidetaka Yabuuchi, Takarazuka; Osamu Eguchi, Katano; Shinji Kondoh, Kawanishi; Haruo Terai, Suita, all of Japan

[73] Assignee: Matsushita Electric Industrial Co., Ltd., Kadoma, Japan

[21] Appl. No.: 828,753

[22] Filed: Jan. 31, 1992

Related U.S. Application Data

[62] Division of Ser. No. 544,952, Jun. 28, 1990, Pat. No. 5,109,566.

[51] Int. Cl.[5] ..... B08B 7/04

[52] U.S. Cl. ..... 134/18; 134/21; 134/42; 15/319; 15/340.1; 180/169

[58] Field of Search ..... 134/18, 21, 42; 15/319, 15/340.1, 340.2; 180/167, 168, 169

[56] References Cited

U.S. PATENT DOCUMENTS

| | | | |
|---|---|---|---|
| 3,381,456 | 5/1968 | Taylor | 134/18 X |
| 3,789,939 | 2/1974 | Geislinger | 15/319 X |
| 3,952,361 | 4/1976 | Wilkins | 15/319 |
| 4,114,711 | 9/1978 | Wilkins | 15/319 X |
| 4,700,427 | 10/1987 | Knepper | 15/319 |
| 5,012,886 | 5/1991 | Jonas et al. | 15/319 X |
| 5,032,775 | 7/1991 | Mizuno et al. | 15/319 X |

FOREIGN PATENT DOCUMENTS

| | | |
|---|---|---|
| 2251271 | 5/1974 | Fed. Rep. of Germany . |
| 227056 | 9/1985 | Fed. Rep. of Germany . |
| 3536974 | 4/1987 | Fed. Rep. of Germany . |

*Primary Examiner*—Mark L. Bell
*Assistant Examiner*—Saeed T. Chaudhry
*Attorney, Agent, or Firm*—Cushman, Darby & Cushman

[57] ABSTRACT

A zone of a floor to be cleaned is subdivided into a plurality of blocks, the position of each block is memorized in a memory of a self-running cleaning apparatus, and the status of each block such that a wall or an obstacle is placed on the block or the block is passed by the cleaning apparatus thereon is also memorized in the memory. The cleaning apparatus moves across the blocks having neither wall nor obstacle thereon and which have not been passed by the cleaning apparatus on the basis of a predetermined priority order in running direction.

13 Claims, 19 Drawing Sheets

SELF-RUNNING CLEANING CONTROL METHOD

This application is a division of our copending application Ser. No. 07/544,952, which became U.S. Pat. No. 5,109,566.

FIELD OF THE INVENTION AND RELATED ART STATEMENT

1. Field of the Invention

The present invention relates generally to a self-running cleaning apparatus, and more particularly those comprising a system for automatically guiding the apparatus to a re-changing location.

2. Description of the Related Art

Self-running cleaning apparatus provided with automatic running mechanism for improving operability in cleaning have been developed. In recent years, further improvements have been made to achieve self-running cleaning machines which are automatically guided by a microcomputer and various sensors provided thereon.

A self-running type cleaning apparatus generally comprises: suction nozzles or brushes under its main housing, running wheels and direction control wheel, which are driven by electric motors, and further, position recognizing sensors for recognizing position and proximity sensors for sensing obstacles to enable the cleaning apparatus to move within the required area in a room.

The above-mentioned conventional self-running type cleaning apparatuses have the following problems:

(1) A secondary battery contained in the housing must be charged at the home (i.e. resting) position of the cleaning apparatus. In order to connect the power source line to the charging terminals of the conventional cleaning apparatus, it is necessary to bring the cleaning apparatus accurately to the resting position and dispose it in the correct direction so that terminals of the charging power line are connected to the reception terminals of the cleaning apparatus. Therefore, the conventional self-running cleaning apparatus does not operate fully automatically throughout to the charging stage.

(2) In the conventional self-running cleaning apparatus, during its moving, the position of the apparatus is determine by relative position identification based on the distance traveled based on the turnings of the running wheel and angles of change of direction given based on the turning of the driving wheel, so that running distances and changes of running directions are accumulated to generate signals for position and direction. Therefore, when the relative identification of the position and directions are in error and thus different from the true values, the cleaning path, and/or the starting point which is identical to the resting point for charging is lost.

Furthermore, the conventional self-running cleaning apparatus is not capable of cleaning narrow gaps between furniture or in corners of the room or the like, and therefore conventional hand driven cleaning apparatus must be used to clean such narrow spaces.

Furthermore in the conventional self-running cleaning apparatus, the program and data for driving a cleaning path must be designed beforehand and stored in the memory of the apparatus. Also the conventional self-running cleaning apparatus cannot be used for cleaning desired spots which have not been stored in the memory by a user.

OBJECT AND SUMMARY OF THE INVENTION

The object of the present invention is to provide a self-running cleaning apparatus which cleans a room in a self-running manner, and when the cleaning of the room is completed, returns to a starting point where the secondary battery on the cleaning apparatus is charged automatically, without a user manually adjusting direction or to manually connecting a charging terminal to the reception terminal of the cleaning apparatus.

The self-running cleaning apparatus in accordance with the present invention comprises:

cleaning means, means for moving the cleaning means, steering means for steering the running means, obstacle detection means for detecting an obstacle preventing advance of the cleaning apparatus, direction detection means for detecting running direction of the cleaning means, distance detection means for measuring a distance from a start position, control means for controlling the moving means and the steering means in a manner that the cleaning apparatus follows a path in a room to evade the obstacles, and at the end of moving returns the cleaning apparatus to a starting position, memory means for memorizing data of the information of the room, a power source for feeding electric power to the apparatus, and charging means which is disposed separate from the above-mentioned components and changes the power source when the cleaning apparatus is in the starting position.

The guiding means of self-running cleaning apparatus of the present invention can certainly guide the self-running cleaning apparatus to the resting or charging position.

The cleaning apparatus of the present invention further can be used for manual cleaning for desired narrow corner or spots by connecting conventional flexible suction hose. The cleaning apparatus is provided with sensors to sense direction and tension of the flexible suction hose, to provide semi-automatic motor-aided running in desired directions through detections of direction and tension of the hose.

Furthermore when an electromagnetic induction power coupling system is provided in the cleaning apparatus, the charging at the charging position can be made without need of delicate mechanical coupling of a charging terminal to the reception terminal of the cleaning apparatus.

When the cleaning apparatus in accordance with the present invention comprises remote type of sensing devices (infrared or ultrasonic type) or contact type (limit switches or pressure sensors) which can detect obstacles to make the steering device turn the direction, the cleaning apparatus can be controlled to certainly sweep the room and return to its charging position.

Furthermore, when the cleaning apparatus is provided with means for detecting charging position, for instance by detecting electromagnetic fields generated around the charging position, by driving the cleaning apparatus once along the inside walls of the room until it returns to the charging position and having the control means identify the charging position which must be identical with the starting position, error in relative positional identification between that calculated by the control means and the actual position is found and the calculated position is calibrated to obtain very accurate self-running operation. Thereby, subsequent scanning-like running in the room for cleaning is carried out very accurately.

In addition, when the charging position has means for generating strong electromagnetic wave and the cleaning apparatus has means for receiving the electromagnetic wave and a rectifier to produce a DC charging current to a secondary battery therein, the charging at the charging position can be made without any mechanical connection of the charging output terminal to the receiving terminal on the cleaning apparatus.

Furthermore, when a hose connection member on the cleaning apparatus has a direction sensor for detecting direction of the hose and a tension sensor for detecting generation of tension when the hose is pulled by user and further by directing the driving control means to drive the moving means of the cleaning apparatus in the direction where to the hose is pulled, the cleaning apparatus automatically moves in the direction where the user pulls the hose.

Also, by providing means to detect connection or non-connection of the hose to the hose connection part on the cleaning apparatus, when the hose is disconnected and removed from the cleaning apparatus the control means receives a homing signal to drive the steering means and the driving means of the cleaning apparatus, to run in the regions of the room not yet cleaned and finally to the charging position, thereby automatically returning the cleaning apparatus.

While the novel features of the invention are set forth particularly in the appended claims, the invention, in both organization and content, will be better understood and appreciated, along with other objects and features thereof, from the following detailed description taken in conjunction with the drawings.

BRIEF DESCRIPTION OF THE DRAWINGS

FIG. 14(*b*) is a path-map in the embodiment;

It will be recognized that some or all of the Figures are schematic representations for purposes of illustration and do not necessarily depict the actual relative sizes or locations of the elements shown.

DESCRIPTION OF THE PREFERRED EMBODIMENT

An embodiment of the present invention is described with reference to relevant figures.

Figure 1:
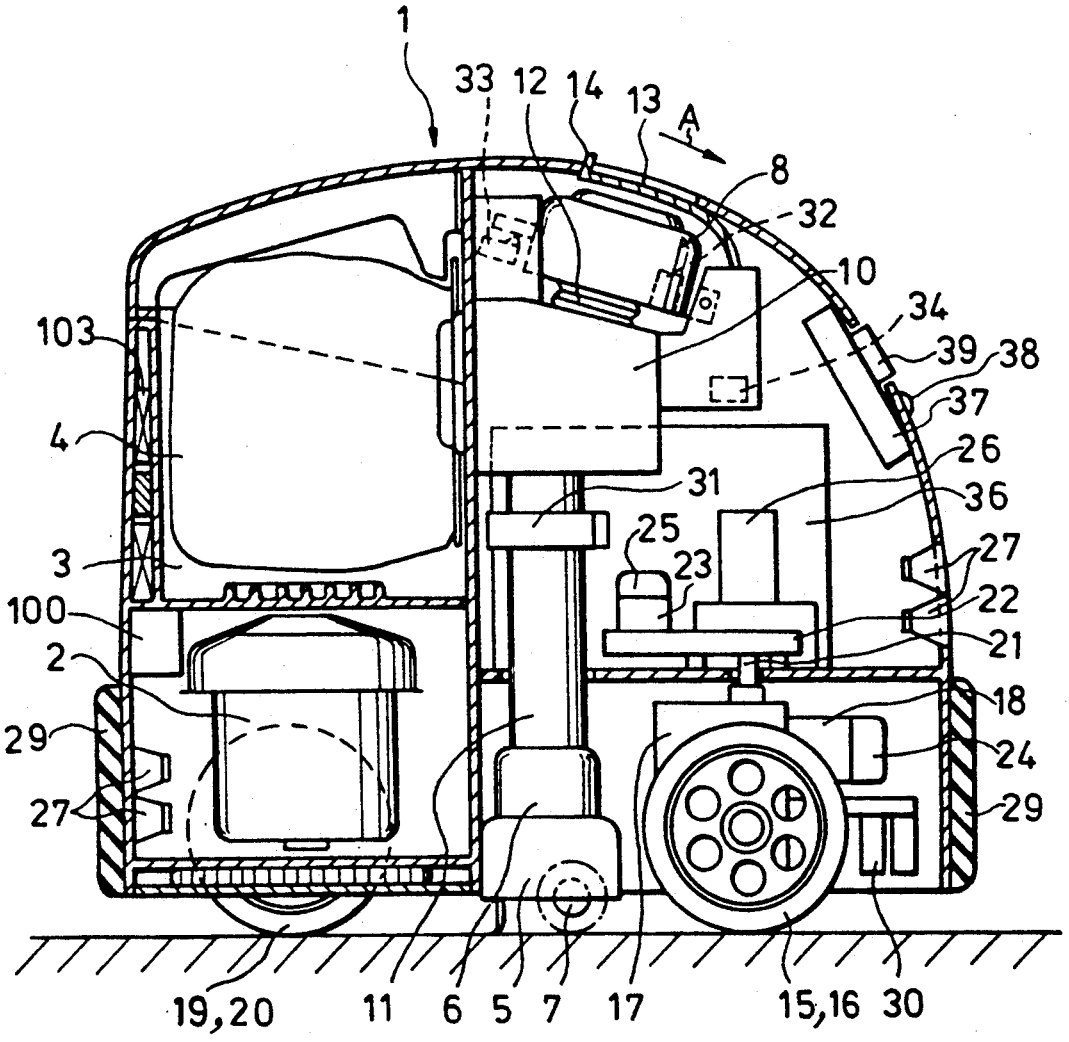
FIG. 1 is a sectional side view of an embodiment of the self-running cleaning apparatus in accordance with the present invention.
Figure 2:
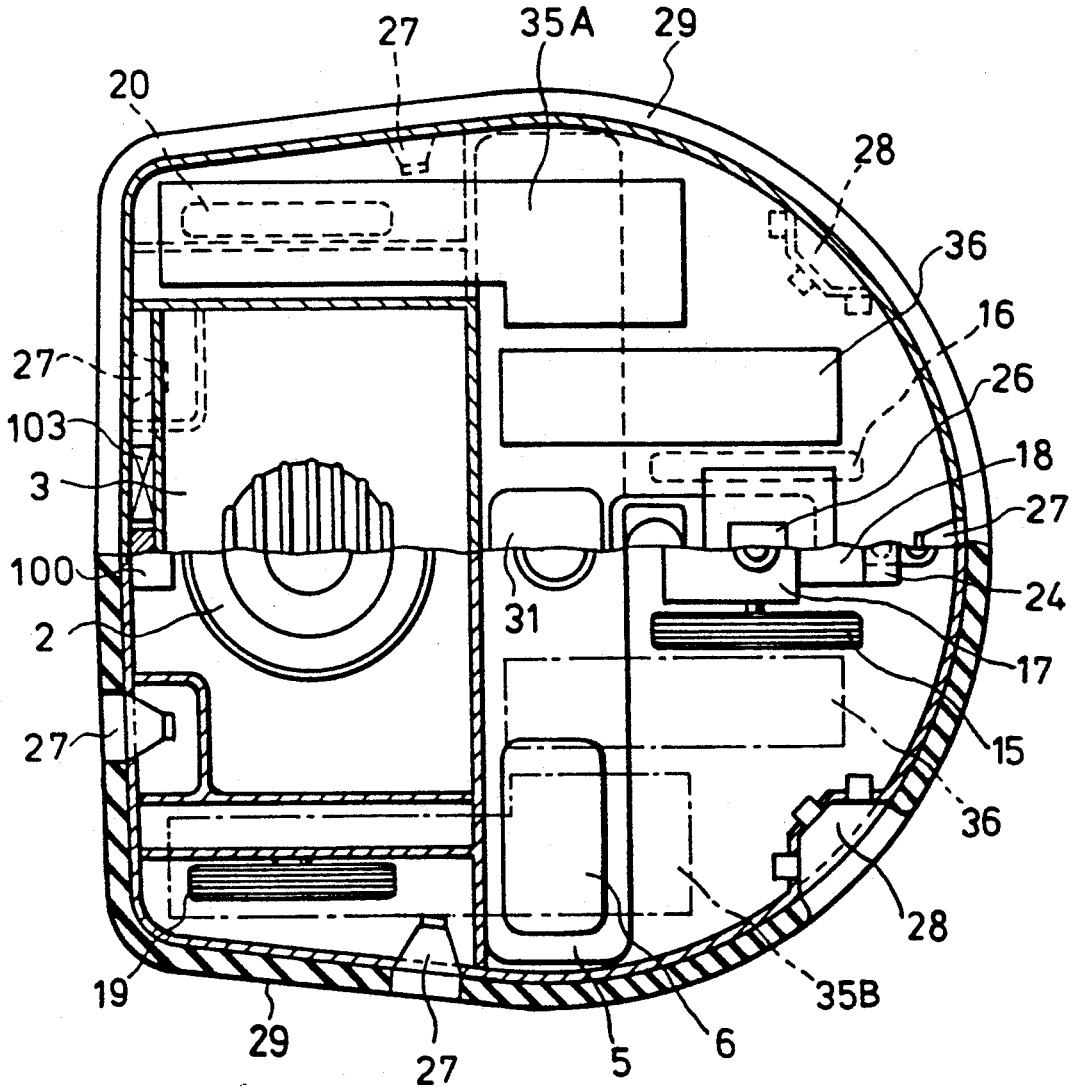
FIG. 2 is a sectional plan view of the embodiment of the self-running cleaning apparatus in accordance with the present invention.
Figure 3:
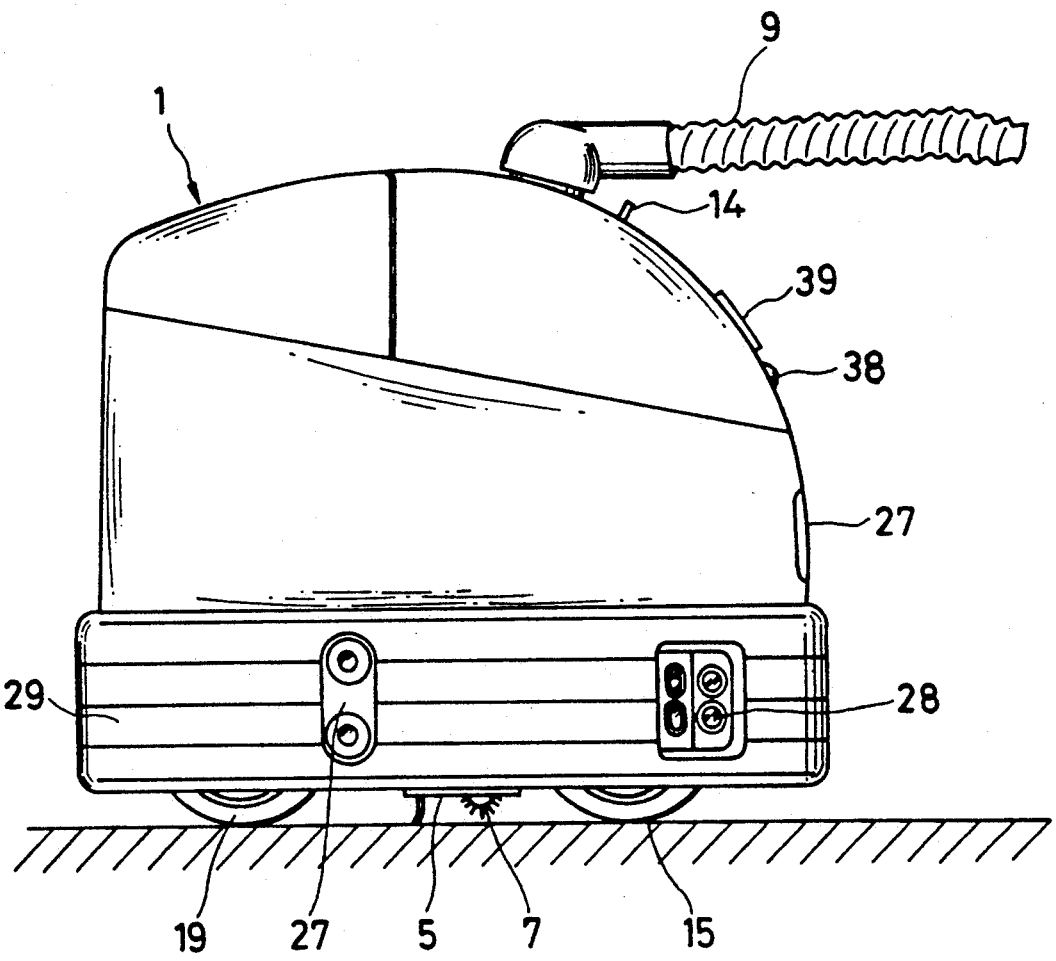
FIG. 3 is a side view of the embodiment.

FIG. 1 is a sectional side view, FIG. 2 is a sectional plan view and FIG. 3 is a side view of the self-running cleaning apparatus in accordance with the present invention, respectively. The cleaning apparatus comprises an electric fan 2 and a dust collection chamber 3 in the main body 1 having a substantially round bottom face. A filter 4 is enclosed in the dust collection chamber 3. A rectangular suction nozzle 5 is disposed on the bottom of the main body 1, and the length of the longer side of the suction nozzle 5 is almost identical with the diameter of the bottom surface of the main body 1. An agitator 7 of a rotating brush which is driven by a drive motor 6 is provided in the suction nozzle 5.

A hose connector 8 for connecting a conventional suction hose 8 is disposed on an upper surface of the main body 1. The suction hose 9 is connected to the hose connector 8 as shown in FIG. 3. The suction hose 9 can be easily disconnected from the hose connector 8. An air path changing device 10 by which the suction intake of the electric fan 2 is switched to the suction nozzle 5 or the hose connector 8 is provided under the hose connector 8. The air path changing device 10 is connected to the suction nozzle 5 through a connection pipe 11, and is connected to the hose connector 8 through a connection hose 12.

The hose connector 8 is covered by a hose connector cover 13 which is slidably held on the inner surface of the upper casing of the main body 1. The hose connector cover 13 is mechanically linked with the air path changing device. When the hose connector 8 is uncovered by sliding the hose connector cover 13, the suction intake of the electric fan 2 is connected to the hose connector 8, and when the hose connector 8 is covered by the hose connector cover 13, the suction intake of the electric fan 2 is connected to the suction nozzle 5. The hose connector cover 13 is manipulated by moving a knob 14 of the hose connector cover 13 to a direction shown by an arrow A as shown in FIG. 1.

Driving wheels 15 and 16 are provided on the bottom of the main body 1, and are driven by a moving motor 18 through a driving part 17. Free wheels 19 and 20 are also mounted on the bottom of the main body 1. The drive part 17 is rotated by a steering motor 23 through a steering shaft 21 and a steering gear 22, and the moving direction of the cleaning apparatus is varied.

A rotary encoder 24 detects a revolution speed of the moving motor 18 and a rotary encoder 25 detects a revolution speed of the steering motor 23. A revolution speed of the driving wheels 15 and 16 are detected on the basis of the detected value of the rotary encoder 24, hence the travel distance of the cleaning apparatus is detected.

A rate gyro is used as a direction sensor 26 for detecting a direction of the main body 1 in the embodiment. The travel distance and the running direction of the main body 1 are detected on the basis of the revolution speed detected by the rotary encoder 24 and the moving direction detected by the direction sensor 26, respectively, and thereby a relative position of the cleaning apparatus with respect to a starting position is recognized.

A plurality of ultrasonic distance sensors 27 and 28 are disposed on the circumferential side wall of the main body 1, and thereby the distance between the main body 1 and obstacles is measured. Two ultrasonic distance sensors 28, 28 which are placed on both sides of the front part of the main body 1 are wider than that of other ultrasonic sensors 27 in sensing angle. Moreover, the main body 1 is provided with a bumper 29 which surrounds the lower outside portion of the main body 1. The bumper 29 has a touch sensor in the same body by which contact with an obstacle is detected. An obstacle detecting means is composed of the ultrasonic distance sensors 27 and 28, and the touch sensor of the bumper 29. A floor sensor 30 composed of a ultrasonic sensor is mounted in front of the drive part 17. The kind of a floor surface such as a carpet or a bare floor and the state thereof such as a concave or a convex of the floor are detected by reflection of ultrasonic waves from the floor surface. Namely, the floor sensor 30 serves as means for determining the kind of floor and means for detecting the concavity or the convexity of the floor.

A dust flow sensor 31 composed of a photo-interrupter is installed in the connection pipe 11, and thereby a quantity of dust flowing in the connection pipe 11 is detected. Cleaning condition detecting means is composed of the floor sensor 30 and the dust flow sensor 31.

A hose direction sensor 32 is provided in the hose connector 8, and thereby the direction of the suction hose 9 with respect to the main body 1 is detected. The hose direction sensor 32 is composed of a potentiometer. A hose tension sensor 33 is mounted on the hose connector 8, and thereby a tension which is applied to the suction hose 9 is detected. The hose tension sensor 33 is composed of a switch which is activated by change in the position of the hose connector 8. A suction hose condition detecting means is composed of the hose direction sensor 32 and the hose tension sensor 33.

A status sensor 34 is installed in the air path changing device 10, and thereby the status of the hose connector cover 13 is detected. A search coil 100 is disposed on a rear side part of the main body 1, and thereby a magnetic field generated by the inductive means 102 which is provided in a charger 101 installed apart from the main body 1 is detected. A coil 103 which is mounted in the main body 1 is for receiving electric power from the inductive means 102 through magnetic field, so that the received electric power is used for charging an electric power source e.g. nickel cadmium batteries 36, 36 of the cleaning apparatus.

Two control circuits 35A and 35B for controlling the cleaning apparatus are disposed in both side parts in the main body 1. The control circuit 35A serves as a signal processing circuit and the control circuit 35B serves as a driving circuit. Two batteries 36, 36 are installed in the main body 1 and supply electric power to the cleaning apparatus. These batteries 36 are disposed over the drive part 17 so that the weight of the batteries 36 is applied mainly to the driving wheels 15 and 16, and thus gripping forces of the running wheels 15 and 16 are increased. An operation panel 37 is mounted on the front of the main body 1, and an operation switch 38, display parts 39 such as a pilot lamp and a buzzer are arranged on the operation panel 37.

Figure 5:
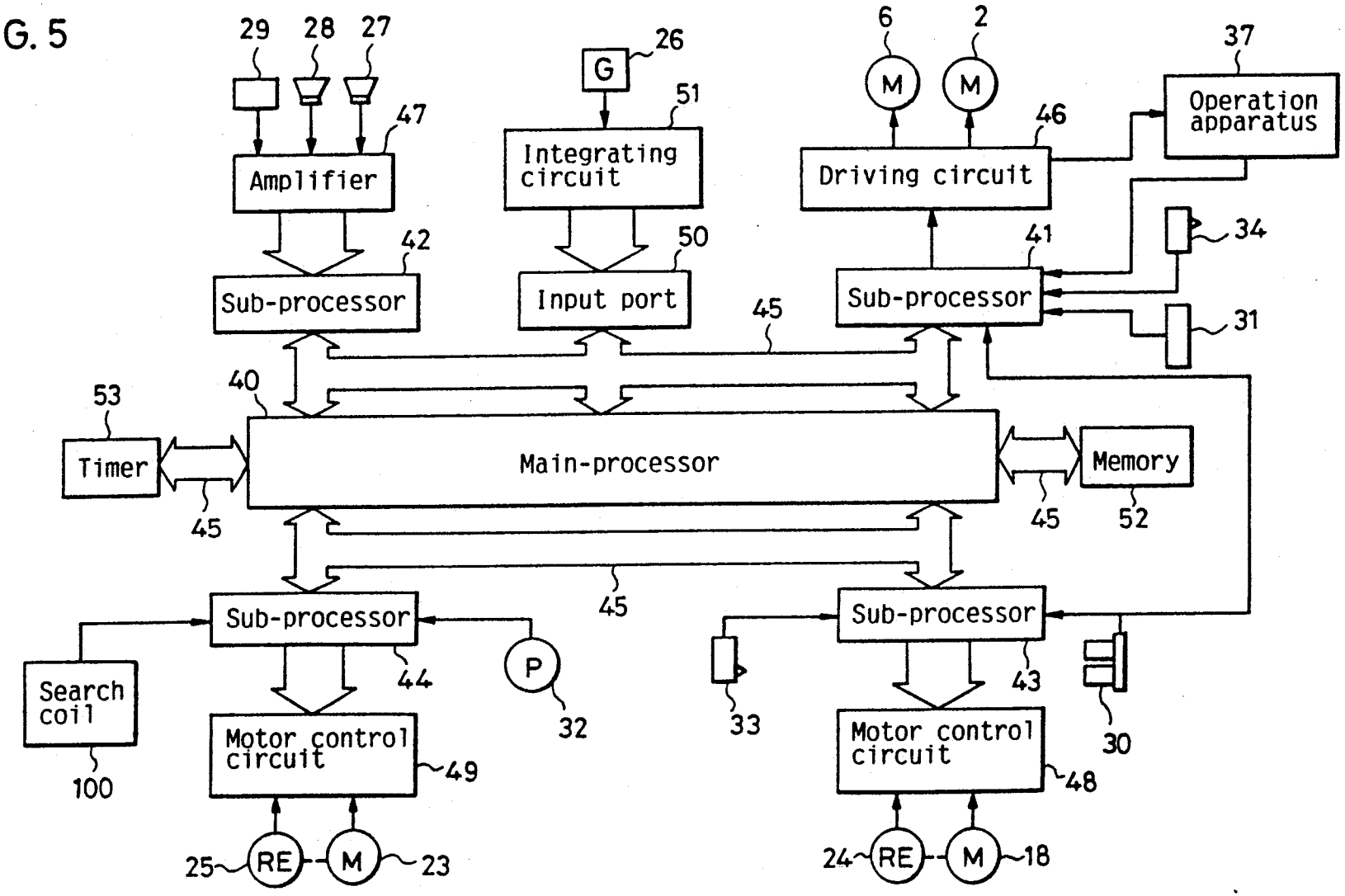
FIG. 5 is a circuit block diagram of the control apparatus of the embodiment.

FIG. 5 is a block diagram of the control circuits 35A and 35B. Referring to FIG. 5, a main processor 40 is composed of a microcomputer. Subprocessors 41, 42, 43 and 44 are composed of one chip microcomputers and are coupled to the main processor 40 through bus lines 45. The subprocessor 41 for controlling cleaning operation processes input signals from the floor sensor 30, dust flow sensor 31, status sensor 34 and operation switch 38. Moreover, the subprocessor 41 processes output signals to the electric fan 2, the driving circuit 46 connected to the driving motor 6 and the display device 39 of the operation panel 37.

Detected signals from the ultrasonic distance sensors 27 and 28 and the touch sensor of the bumper 29 are input to the subprocessor 42 for detecting the obstacles through an amplifier 47. The subprocessor 43 for controlling the moving motor 18 is connected to the motor control circuit 48 to which the moving motor 18 and the rotary encoder 24 are connected. Moreover, the floor sensor 30 and the hose tension sensor 33 are connected to the subprocessor 43. The subprocessor 44 for controlling the steering motor 23 is connected to the motor control circuit 49 to which the steering motor 23 and the rotary encoder 25 are connected. Furthermore, the hose direction sensor 32 and the search coil 100 are connected to the subprocessor 44. The subprocessors 43 and 44 serves as a controller for moving the cleaning apparatus.

An integrating circuit 51 to which an output signal from the direction sensor 26 is input is connected to the bus line 45 through an input port 50. A memory 52 for memorizing programs and/or data and a timer 53 are connected to the main processor 40. Predetermined times can be set in the Timer 53. Hence, the cleaning apparatus can be set to begin operating automatically at each predetermined time. Two batteries 36, 36 supply an electric powers to the above-mentioned control system. The batteries 36, 36 are automatically charged when a voltage which is higher than the output voltage of any one of the battery 36 is induced in the induction coil 103.

Figure 6:
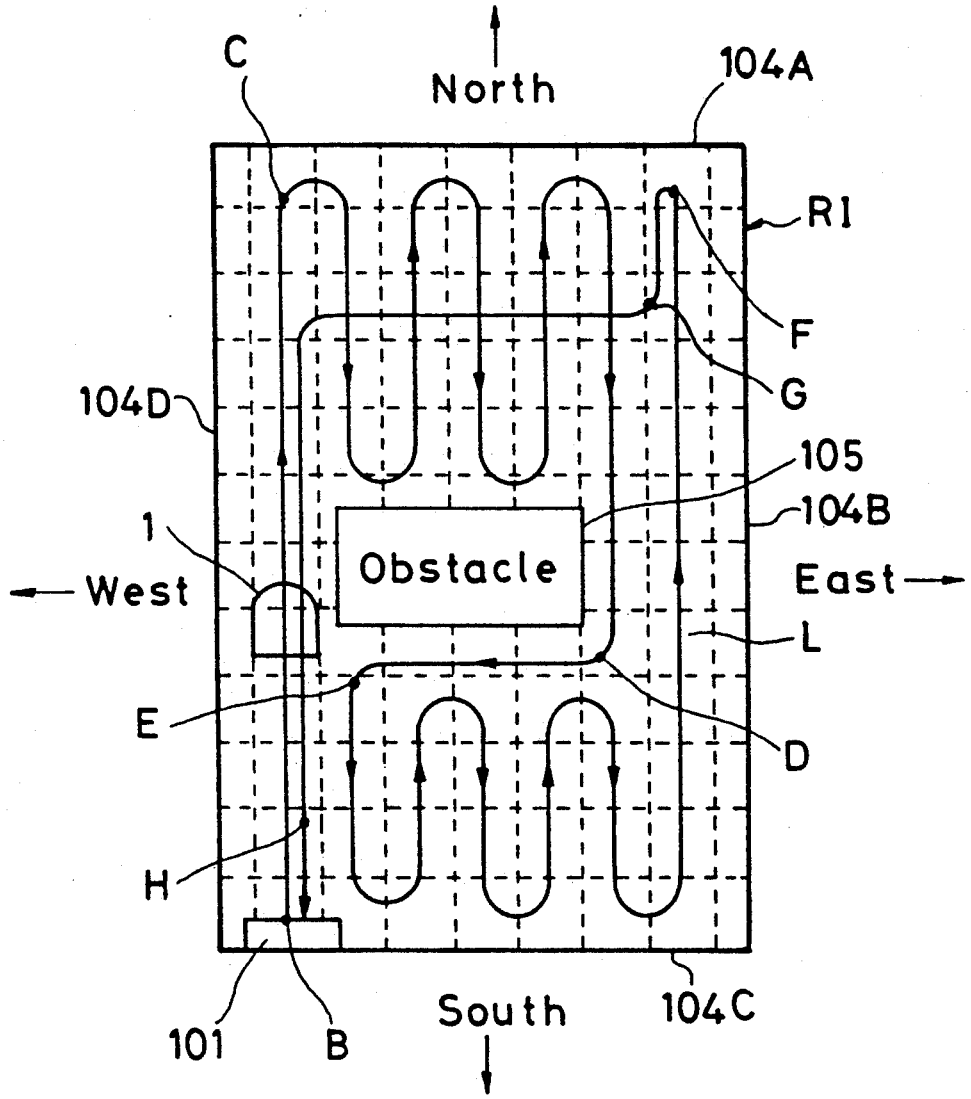
FIG. 6 is a plan view of a moving path of the cleaning apparatus in a room.

FIG. 6 is a plan view of a room R1 to be cleaned by the cleaning apparatus in accordance with the present invention. A moving path of the main body 1 of the cleaning apparatus in a first embodiment of operation is shown by a line L and the direction thereof is shown by arrows attached on the line L. The room R1 is surrounded with a north wall 104A, an east wall 104B, a south wall 104C and a west wall 104D. An obstacle 105 is placed at the central part of the room R1. The main body 1 is placed at the starting position B at which the batteries of the main body 1 is charged by charger 101. The suction hose 9 is removed from the main body 1, and the hose connector cover 13 covers the hose connector 8. Consequently, the air path changing device 10 is switched to the suction nozzle 5.

After manipulation of the operation switch 38, the main processor 40 outputs an order signal for starting cleaning to the subprocessor 41, and simultaneously, outputs an order signal to the subprocessors 43 and 44.

Hence, the revolution of the electric fan 2 is started and the moving motor 15 is driven, and the main body 1 starts running to clean the room.

A block-map of a room R1, as shown in FIG. 6, comprises a plurality of squares which divide the room R1 lengthwise and crosswise. A block-map is represented by positional data of each square (hereinafter is referred to as a block), and the positional data is stored in advance in a memory 52 of the cleaning apparatus as shown in FIG. 5. The main body 1 moves on the block-map in a manner which is determined in a predetermined priority order. The priority order in the embodiment, as shown in FIG. 6, is predetermined by the moving directions of the main body 1. The directions of the west, south, north and east have priorities in the named order. The detected signals of the direction sensor 26 and the rotary encoder 24 are inputted to the main processor 40 through the subprocessor 43, and a relative position of the main body 1 from the starting position B is recognized. When the main body 1 passes a block, the positional data of the block is stored in the memory as a passed-block. Moreover, when an obstacle 105 is detected by the ultrasonic distance sensor 27 or 28 or the touch sensor of the bumper 29, a detected signal is output from the ultrasonic distance sensor 27 or 28 and/or the touch sensor of the bumper 29. The detected signal is received by the main processor 40 through the subprocessor 42, and the block on which the main body can not run due to the obstacle 105 is also identified as a passed block. The main processor 40, in addition to the above-mentioned basic operation, determines a moving path in a manner that the main body 1 does not come on the block which was already passed. The order signal of the main processor 40 is applied to the subprocessor 43 for controlling the running motor 18 and the subprocessor 44 for controlling the steering motor.

In the manner described above, the main body 1 started from the starting position B runs to the north because west and south of the main body 1 are the walls, and the north is given priority to the east. When the main body 1 arrives at a position C which is in front of the wall 104, since the ultrasonic distance sensor 27 detects the wall 104, the main body 1 does not run forward. Whereat the main body 1 turns by 180°, and runs to the south, because the south is given priority to the east. Then the main body 1 arrives in front of the obstacle 105. Subsequently, the main body 1 turns counterclockwise by 180° and runs to the north. As mentioned above, the main body 1 turns by 180° whenever it arrives in front of the wall or the obstacle.

When the main body 1 arrived at the position D of a corner of the obstacle 105, the main body 1 can run to the west which has the highest priority. Consequently, the main body 1 turns to the right direction and runs to the west along the obstacle 105.

When the main body 1 arrived at a position E, the main body 1 turns to the south, since a block which has already passed by the main body 1 is in front of the main body 1. Then, the main body 1 turns by 180° in front of the south wall 104C of the room R1, and runs between the obstacle 105 and the south wall 104C of the room R1. Finally, the main body 1 runs along the east wall 104B of the room R1. Then, the main body 1 arrives at a position F and finishes cleaning operation.

Figure 13:
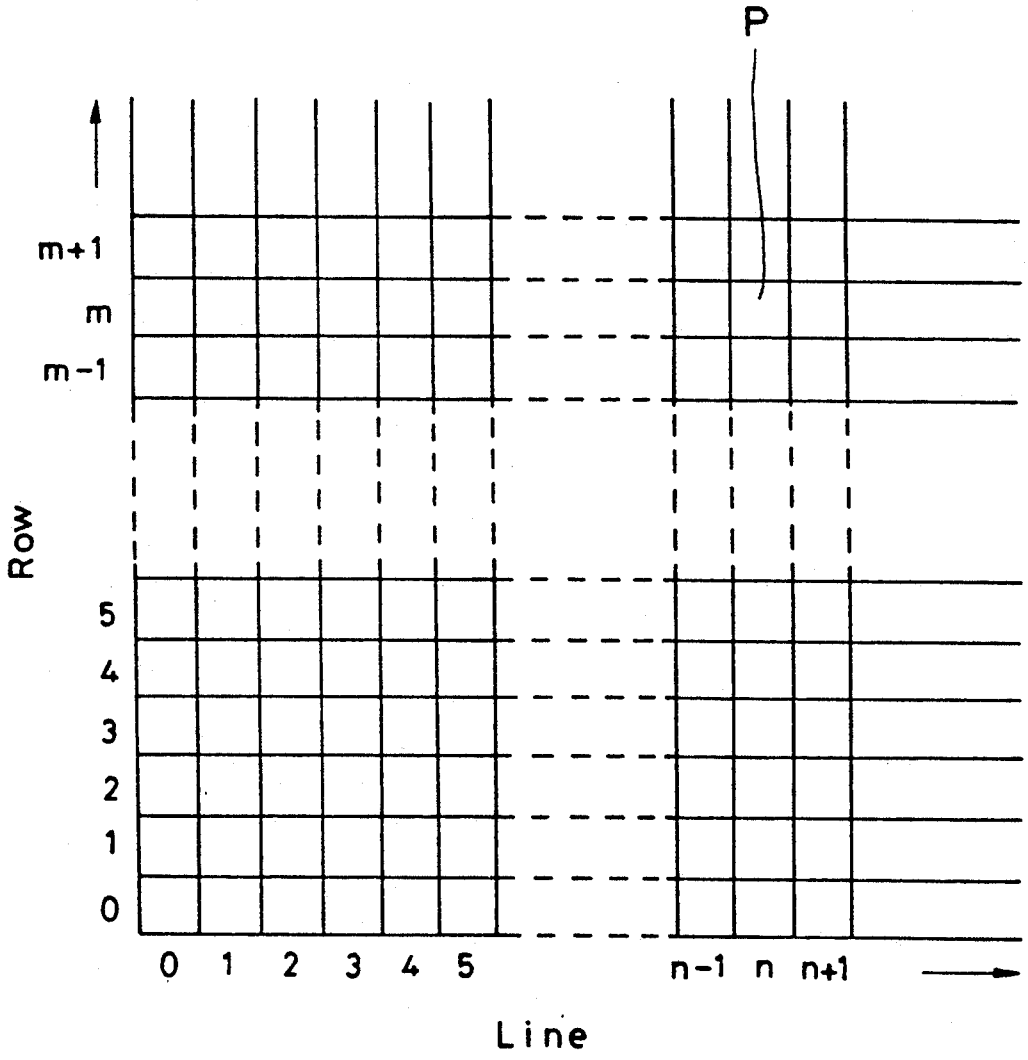
FIG. 13 is a block-map in the embodiment.

The block-map for determining moving path of the main body 1 is elaborated hereafter. FIG. 13 is a block-map which is used in the embodiment. The block-map is formed by subdividing an area to be cleaned. The area is divided in the line direction and in the row direction into segments having a predetermined length which is slightly smaller than the length of the longer side of the suction nozzle 5. Each block corresponds to each address of the memory 52. In the embodiment, two sets of the addresses corresponding to the blocks of two block-maps are provided in the memory 52. One of the two sets records the presence, the wall and obstacles in the block-map, and the other represents the moving path which was passed by the main body 1. A block which records the position of the wall or obstacle is represented by bit "1" in the corresponding address for recording the wall and obstacle. In a similar manner, a block which was already passed by the main body 1 is also represented by bit "1" in the corresponding address for recording of the passed path. Other blocks are represented by bit "0". Each segment in the line and row is represented by sequential number 0, 1, 2, - - - , n−1, n, n+1 and 0, 1, 2, - - - , m−1, m, m+1, respectively. For example, in FIG. 13, a block P is represented by block (n,m) wherein the values n and m are obtained by calculation in the main processor 40.

Figure 14A:
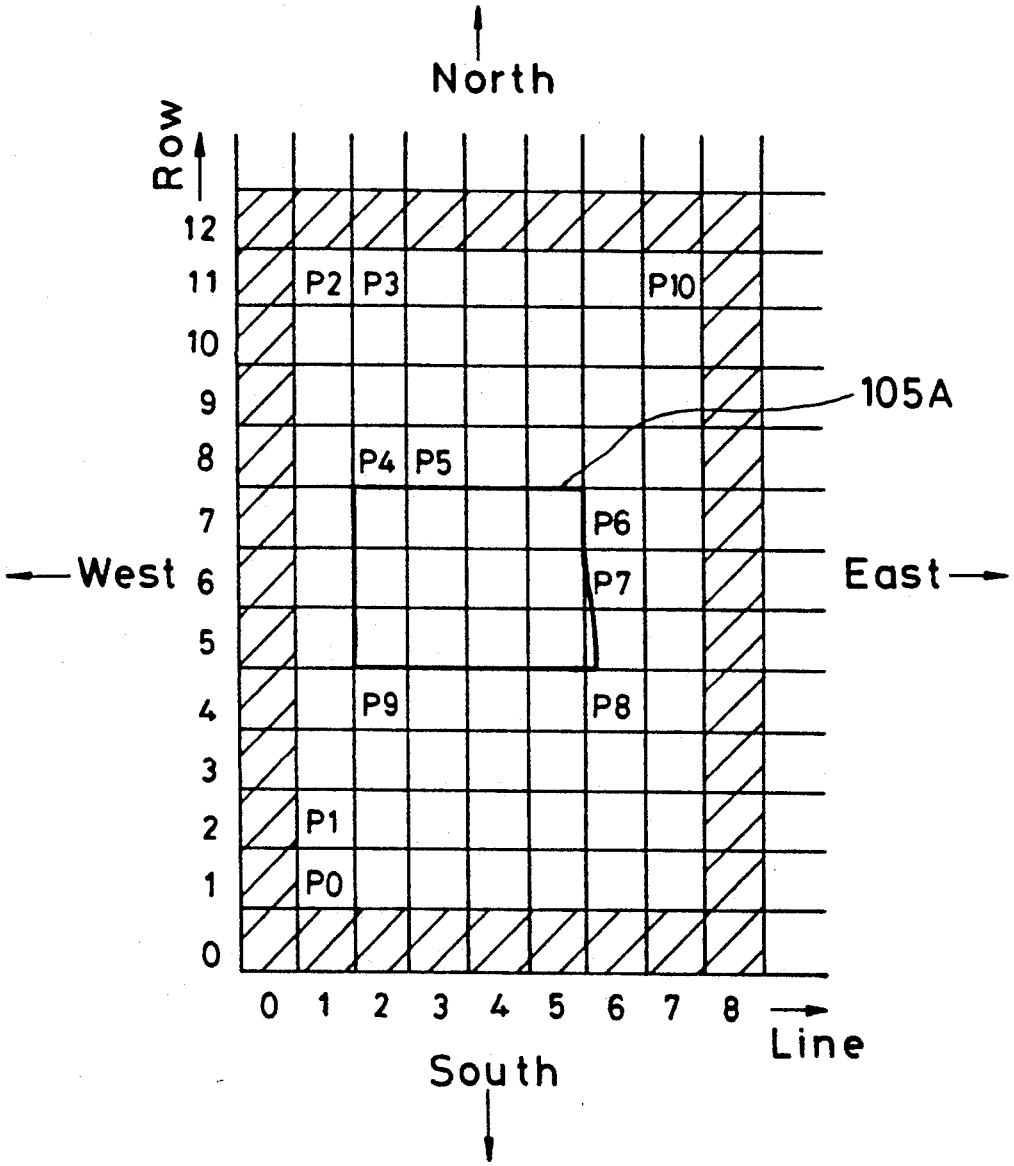
FIG. 14(*a*) is a well and obstacle map in the embodiment.
Figure 14B:
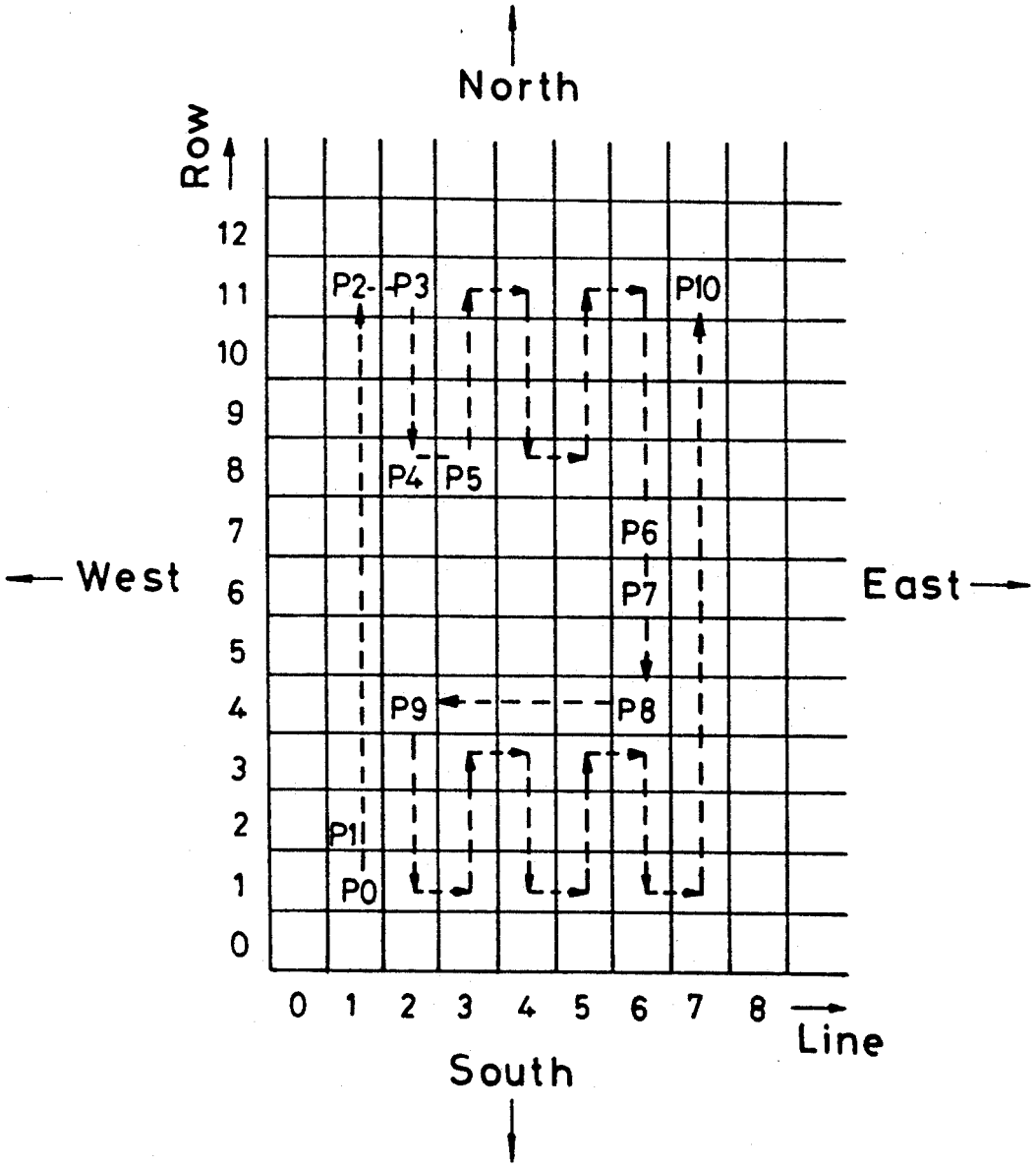
Figure 15:
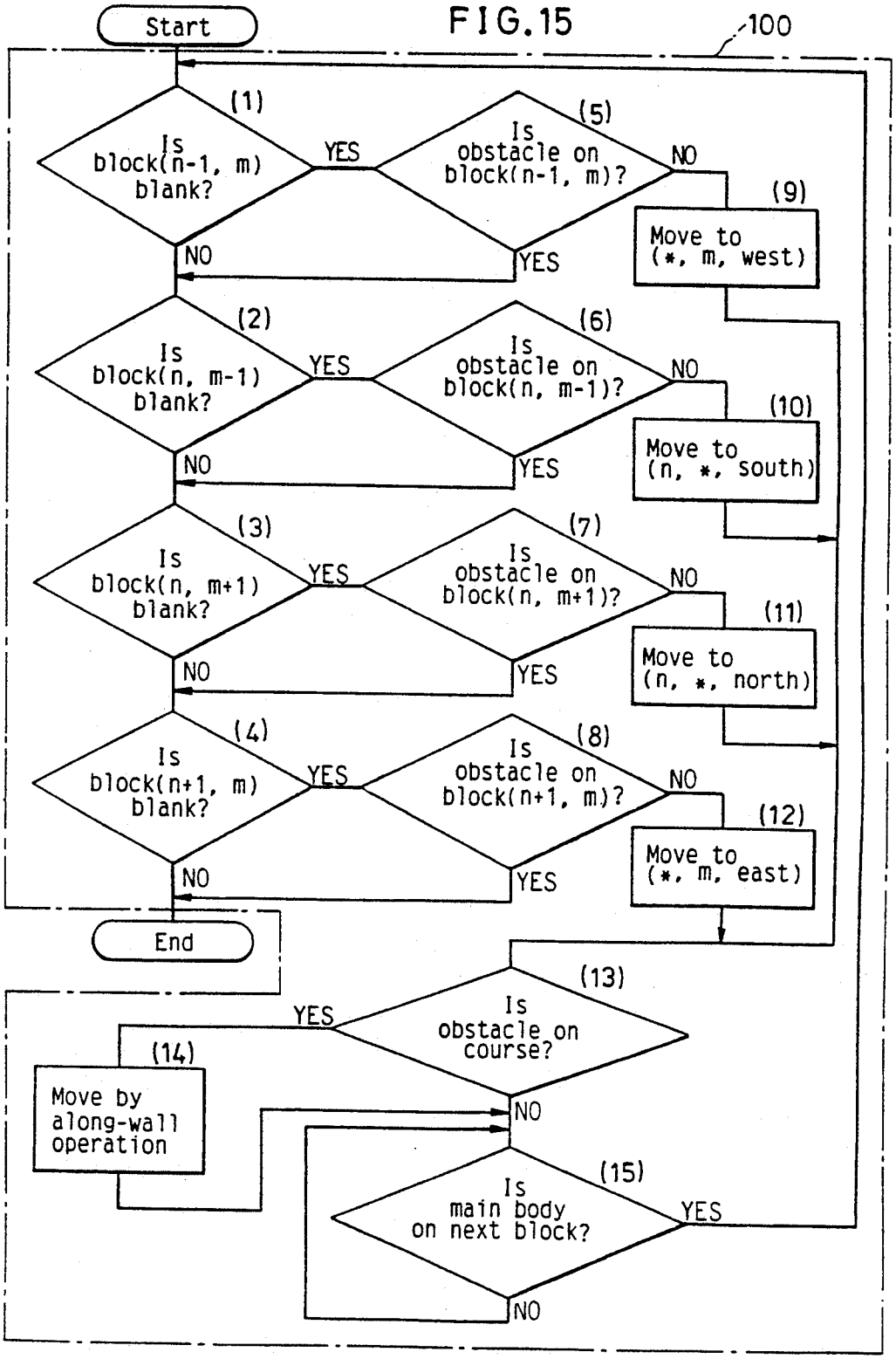
FIG. 15 is a flow chart of the control operation in the embodiment.

An algorithm for determining a moving direction of the main body 1 is elucidated with reference to FIG. 14(*a*), FIG. 14(*b*) and FIG. 15. FIG. 14(*a*) is an example of a block-map in the embodiment. Referring to FIG. 14(*a*), hatched blocks in the block-map represent the wall. The blocks enclosed in a frame represents an obstacle 105A. FIG. 14(*a*) represents a "wall and obstacle map", and FIG. 14(*b*) represents a "passed-path map". In the passed-path map shown in FIG. 14(*b*), a dotted line represents the path which was already passed by the main body 1. The main body 1 moves on the centers of the respective blocks.

When the main body 1 moves to the north on the n nth line, the moving direction OL is represented here by an expression (n, *, north). Referring to figures, the upward direction is the north, the downward direction is the south, the leftward direction is the west and the rightward direction is the east. "Along-wall" operation represents to move along a wall or along an obstacle with a predetermined interval therebetween. In the along-wall operation, the main body 1 travels along the wall on the basis of the detected signals of the ultrasonic distance sensors 27 and 28.

The moving direction of the main body 1 is determined on the basis of the status of blocks of the east, west, south and north with respect to the present position of the main body 1 and the information of the wall or the obstacle detected by the ultrasonic distance sensors 27 and 28. When there is neither wall nor obstacle, and main body 1 travels on a block, the moving direction of the main body 1 is determined on the basis of the priority order of the directions. Moreover, when the ultrasonic distance sensors 27 and 28 detect an obstacle, the main body 1 runs on the basis of the "along-wall" operation. Additionally, in determination of the moving direction, the information from the ultrasonic distance sensors 27 and 28 has priority to the information of the block-map. Recorded in the memory 52

Operation for determining a moving direction on the basis of the block-map is elucidated hereafter. Referring to FIG. 14(*a*), at a starting position PO, a block (0, 1) and a block (1, 0) are on the wall. The status of these blocks is recognized on the basis of the block-map and the information from the ultrasonic distance sensor. Consequently, the main body 1 can not go to the blocks (0, 1) and (1, 0). Thus, the main body 1 can go to the block (1, 2). The above-mentioned status of the main body 1 is represented by OL=(1, *, north). Subsequently, at the position P1, the main body 1 can not go to the blocks (0, 2) and (1, 1) since the block (0, 2) is on the wall and the block (1, 1) is already passed. A movable block of the main body 1 is block (1, 3). The status is represented by OL=(1, *, north). Then, the main body 1 moves to the position P2. At the position P2, since the block (0, 11) is on the wall and the block (1, 10) is on the path which has passed by the main body 1, the main body 1 can not get to the blocks (0, 11) and (1, 10). Additionally, the block (1, 12) is on the wall. Consequently, the main body 1 can go to the block (2, 11), and the status of the main body 1 is represented by OL=(*, 11, east). Consequently, the main body 1 moves to the block (2, 11), (position P3).

At the position P3, the block (1, 11) is already passed. Therefore, the main body 1 can go to the block (2, 10). The status of the main body 1 is represented by OL=(2, *, south). Then, the main body 1 arrives at a position P4. At the position P4, the blocks (1, 8) and (2, 9) are already passed, the block (2, 7) is on the obstacle. Therefore, the main body 1 can go to the block (3, 8) (position P5). The status is represented by OL=(*, 8, east). Then, the main body 1 arrives at a position P5.

At the position P5, though the main body 1 can go to the north or the east, since the north has priority to the east, the main body 1 moves to the north. This status is represented by OL=(3, *, north). In a manner similar to that described hereinabove, the main body 1 arrives at a position P6. At the position P6, the main body 1 can go to the block (5, 7) according to the block-map. However, the block (5, 7) is on the obstacle 105A. The obstacle 105A is detected by the ultrasonic distance sensors 27 and 28. Consequently the main body 1 can not go to the block (5, 7), and according to the priority order, the main block 1 can go to the south. This status is represented by OL=(6, *, south).

On the blocks (6, 6) and (6, 5), the obstacle 105A is protruded in these blocks. Therefore, the main body 1 can not move along the center of the respective blocks (6, 6) and (6, 5). In the above-mentioned case, the main body 1 runs along the obstacle 105A by the "along-wall" operation. When the main body 1 arrived at the position P8, the main body 1 can go to the east, the south or the west, but the west has priority to the east and the south. Thus the main body 1 can go to the west. The status is represented by OL=(*, 4, west), and the main body 1 moves on a position P9.

At the position P9, the block (1, 4) is on the path which was passed in movement from the position P1 to the position P2. Thus the main body 1 can not go to the block (1, 4). Consequently, the main body 1 can go to the block (2, 3), and the status is represented by OL=(2, *, south). In a manner similar to that described hereinabove, the main body 1 arrives at a position P10. At the position P10, the blocks (6, 11) and (7, 10) are already passed, and the blocks (7, 12) and (8, 11) are on the wall. Thus, the main body 1 can not move any direction, and the cleaning operation is finished. The main body 1 moves all the cleaning area by the above-mentioned process. After then, by determining moving directions on the basis of the wall and obstacle map and information from the ultrasonic distance sensor, the main body 1 can return to the starting position P0.

FIG. 15 is a flow chart of the above-mentioned process.

Referring to FIG. 15, the main body 1 is on the block (n, m). In steps (1), (2), (3) and (4), the status of the blocks of left, rear, front and right of the main body 1 is examined, respectively in the named order. The term "blank" in the flow chart means that a block is not passed by the main body 1. Examinations in steps, (5), (6), (7) and (8) are made by the ultrasonic distance sensors 27 and 28. The course of the main body 1 is determined in steps (9), (10), (11) or (12) on the basis of the result of the examinations in the steps (1)–(8). When the main body 1 can not move on the center of the respective blocks due to existence of an obstacle (step (13)), the "along-wall" operation is applied in step (14). Finish of the moving operation from a block to next block is examined in step (15).

Figure 16:
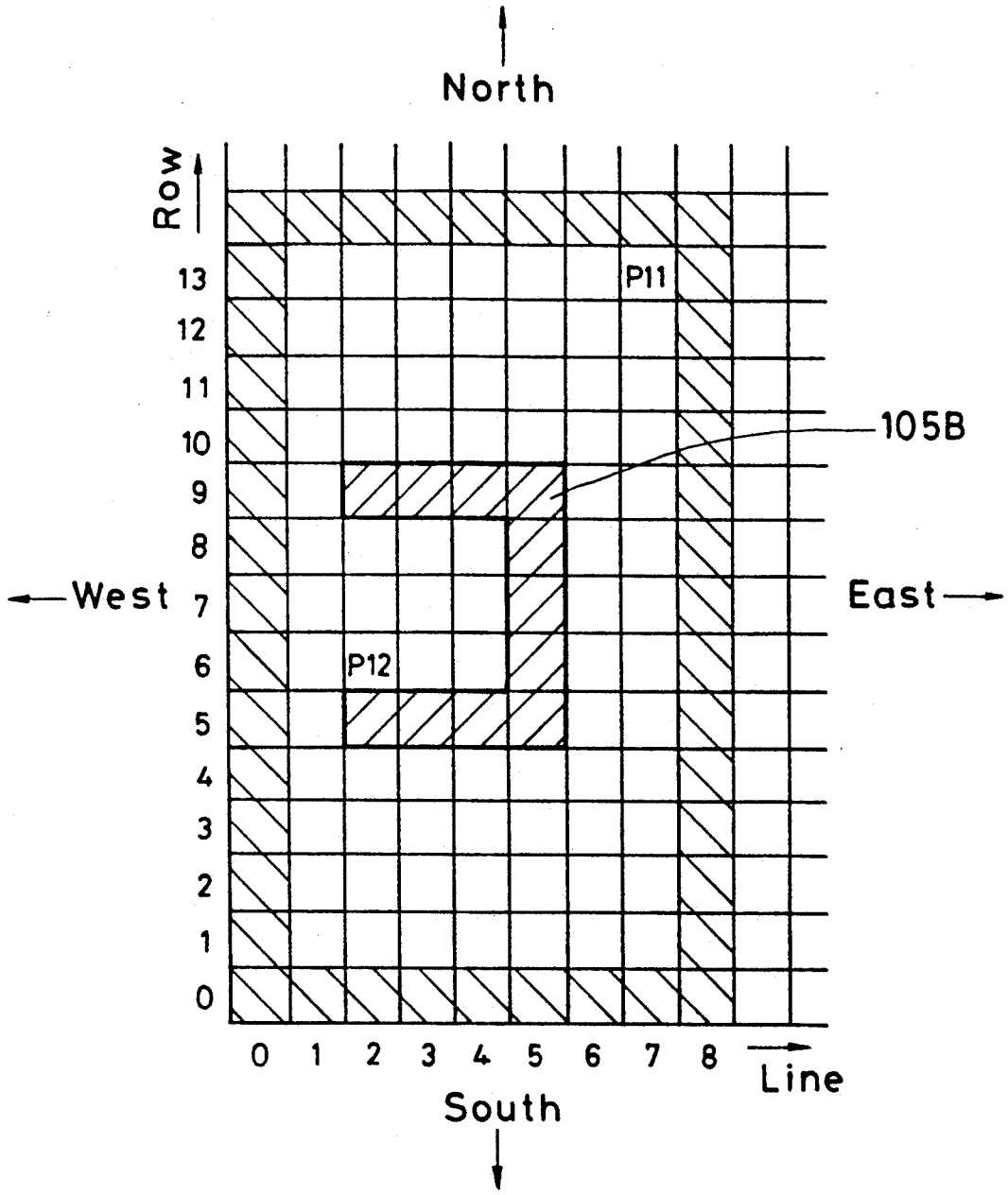
FIG. 16 is a block-map of a room having an obstacle.

FIG. 16 is a plan view of a room having a U-shaped obstacle 105B. When movement of the main body 1 is controlled on the basis of the above-mentioned algorithm in the room shown in FIG. 16, the main body 1 can not enter in the area in the U-shaped obstacle 105B. In the above-mentioned case, after the main body 1 arrived at a position 11 in a similar manner shown in FIG. 14(*a*), entire blocks in the block map is examined and the block on which the main body 1 does not pass is determined. Consequently, the main body 1 is shifted to the position 12 of the westernmost and southernmost block in the blocks on which the main body 1 do not pass. The block on the position 12 is given priority to other blocks on which the main body 1 do not pass on the basis of the priority order of the moving direction. After then, the main body 1 is controlled on the basis of the process shown in FIG. 15.

In the embodiment, when the moving direction of the main body 1 is changed, the main body 1 stops and turn to the subsequent running direction. Error of the direction detecting means is corrected at every stop of the main body 1.

In the above-mentioned operation of the main body 1, in the embodiment, if the room is surrounded by a wall and there is no opening adjacent to the floor of the room, the main body 1 can be operated to clear the entire floor of the room without use of memorized data in the block-maps. In the above-mentioned case, the course of main body 1 is determined on the basis of the detected signal of the ultrasonic distance 27 and 28 and the priority order in the moving direction. After the above-mentioned operation of the main body 1, the data of the path which is passed by the main body 1, memorized in one set of the addresses of the memory 52. Moreover, the data of the positions of the wall and an obstacle are memorized in the set of addresses of the memory 52.

Referring to FIG. 6, after the main body 1 arrived at the position F, the main body 1 moves backward to a position G. At the position G, the main body 1 moves to the left which has priority to other directions. After then, the main body 1 moves to the starting position B along a predetermined course. When the main body 1 arrived in front of the starting position B, the main body 1 turns by 180° at a position H, and moves backward to the starting position B.

Figure 4:
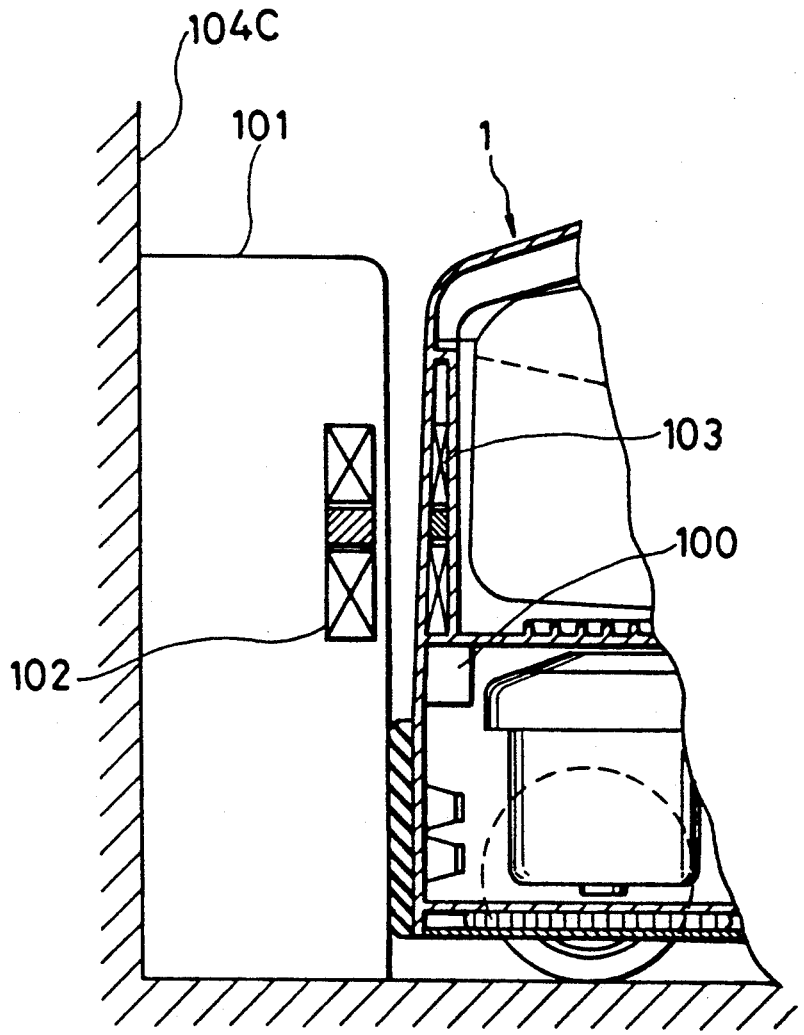
FIG. 4 is a sectional side view of the embodiment which is placed at the starting position at which an electric power is supplied to the cleaning apparatus by an induction coupling means.

At the starting position B, as shown in FIG. 4, the induction coil 103 of the main body 1 is held to be coupled inductively to the induction coil 102 which is provided in the charger 101. Thus, an alternating current is supplied to the main body 1 from the charger 102. In the main body 1, the alternating current is rectified by a rectifier (not shown in the drawings) provided in the main body 1, and a DC current is supplied to the battery 36. Since the induction coupling means can supply an electric power without contact means, high reliability connection is realized. Moreover, since electric contacts are not expose on the charger 101, safety in the operation is maintained. However, if necessary by some reason, electric contacts can be usable for supplying electric power to the main body 1.

In the moving operation, when the main body 1 meets a step-shaped obstacle such as stairs, a detecting signal is output from the floor sensor 30. The detecting signal is received by the subprocessor 43 for controlling the moving motor 18, and the moving motor 18 is immediately stopped. The main processor 40 issues an order for evading the step-shaped obstacle. In the above-mentioned case, the position of the step-shaped obstacle is memorized in the block map of the memory 52.

In the cleaning operation of the embodiment, a flow rate of the dust which is sucked through the suction opening 5 is detected by the dust flow sensor 31. The suction force of the electric fan 2 is controlled by the subprocessor 41, and is decreased when the flow rate of the dust is lower, and the suction force of the electric fan 2 is increased when the flow rate of the dust is higher than usual. Thereby, waste of the electric power of the battery 36 is saved, and suction noise is decreased.

Floor surface determining signal of the floor sensor 30 is applied to the subprocessors 41 and 43. When the floor is covered with a carpet, the drive motor 6 of the agitator 7 is rotated. The agitator 7 is not rotated on a bare floor.

In the embodiment, the main processor 40 issues only the order for starting and finishing the cleaning operation. The subprocessor 41 for controlling cleaning operation controls the electric fan 2 and the drive motor 6 of the agitator 7 on the basis of the output signal from floor determining means composed of the floor sensor 30 and cleaning condition detecting means composed of the dust flow sensor 31.

Figure 7:
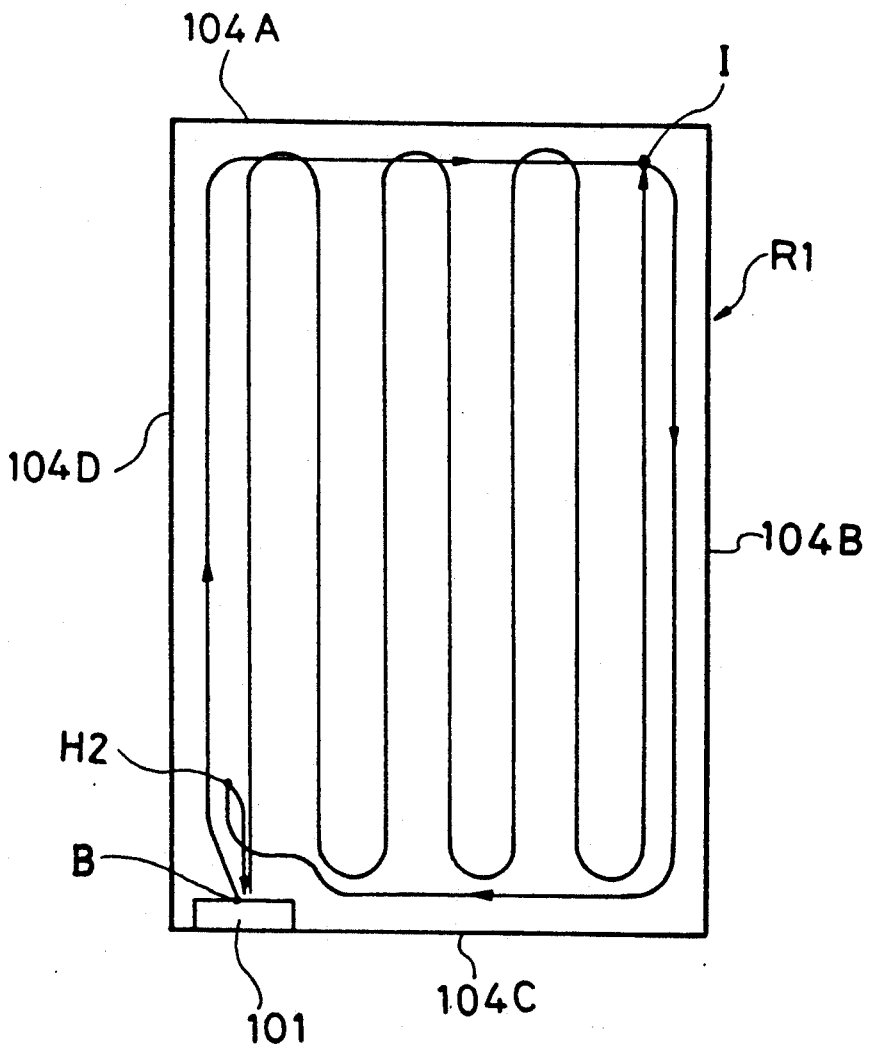
FIG. 7 is a plan view of a moving path of the cleaning apparatus in other example of the room.
Figure 17:
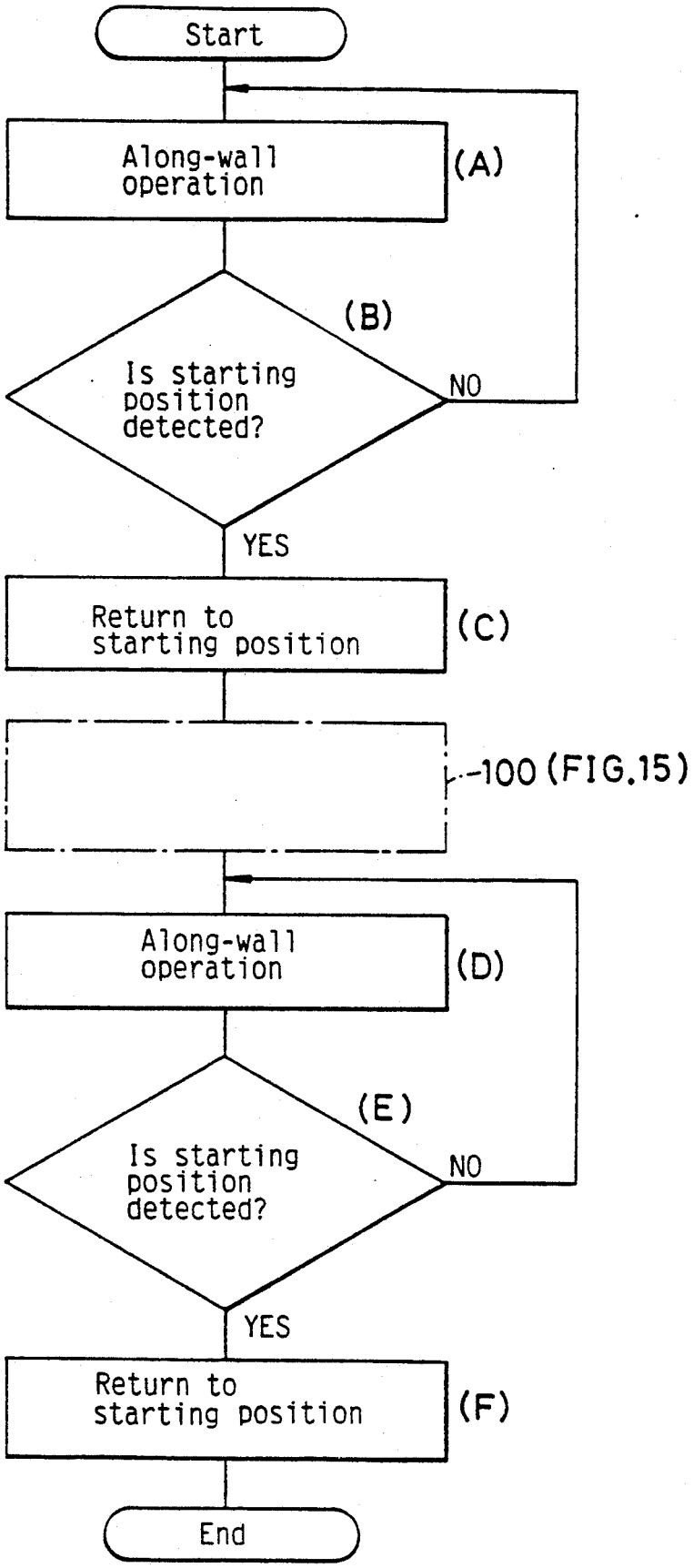
FIG. 17 is a flow chart of a control method of a second embodiment.

FIG. 7 is a plan view of a moving path of the main body 1 in a second embodiment of operation. In the second embodiment, as shown in the flow chart of FIG. 17, first, the main body 1 which is placed at the starting position B is moved along the west wall 104D, the north wall 104A, the east wall 104B and the south wall 104C in the named order, and arrives at a position H2 (step (A)). Then the main body 1 goes backward to the starting position B (Steps (B) and (C)).

Second, the main body 1 starts from the starting position B, and is moved along the path in a manner similar to the first embodiment (steps (1)-(16)). The cleaning operation of the main body 1 is finished at a position I. After then, the main body 1 is returned to the starting position B along the walls 104B and 104C (steps (D), (E) and (F)).

According to the second embodiment, every nook and corner of the room defined by the walls 104A, 104B, 104C and 104D can be cleaned.

Moreover, in return operation from the position I to the starting position B, since the main body 1 is moved along the walls 104B and 104C, even if the main body 1 cannot correctly arrive at the position I due to an accumulated error in determination of the position thereof, the main body 1 can be returned to the starting position B.

The returning operation of the main body 1 to the starting position B is briefly elucidated hereafter. When the main body 1 arrives in front of the starting position B which is provided with the charger 101, a magnetic field which is generated by the inductive coil 102 of the charger 101 is detected by the search coil 100 of the main body 1. The output of the search coil 100 is communicated to the main processor 40 via the subprocessor 44. Then, the main processor 40 issues an order to the subprocessor 43 for running, and to the subprocessor 44 for steering. Thus the main body 1 is led to a position H2. The direction of the main body 1 is changed at the position H2 and the rear of the main body 1 is faced to the charger 101. Then the main body 1 runs backward, thus the main body 1 is positioned at the starting position B. In the above-mentioned operation, the error of the relative position of the main body 1 with respect to the starting position is corrected.

Figure 8:
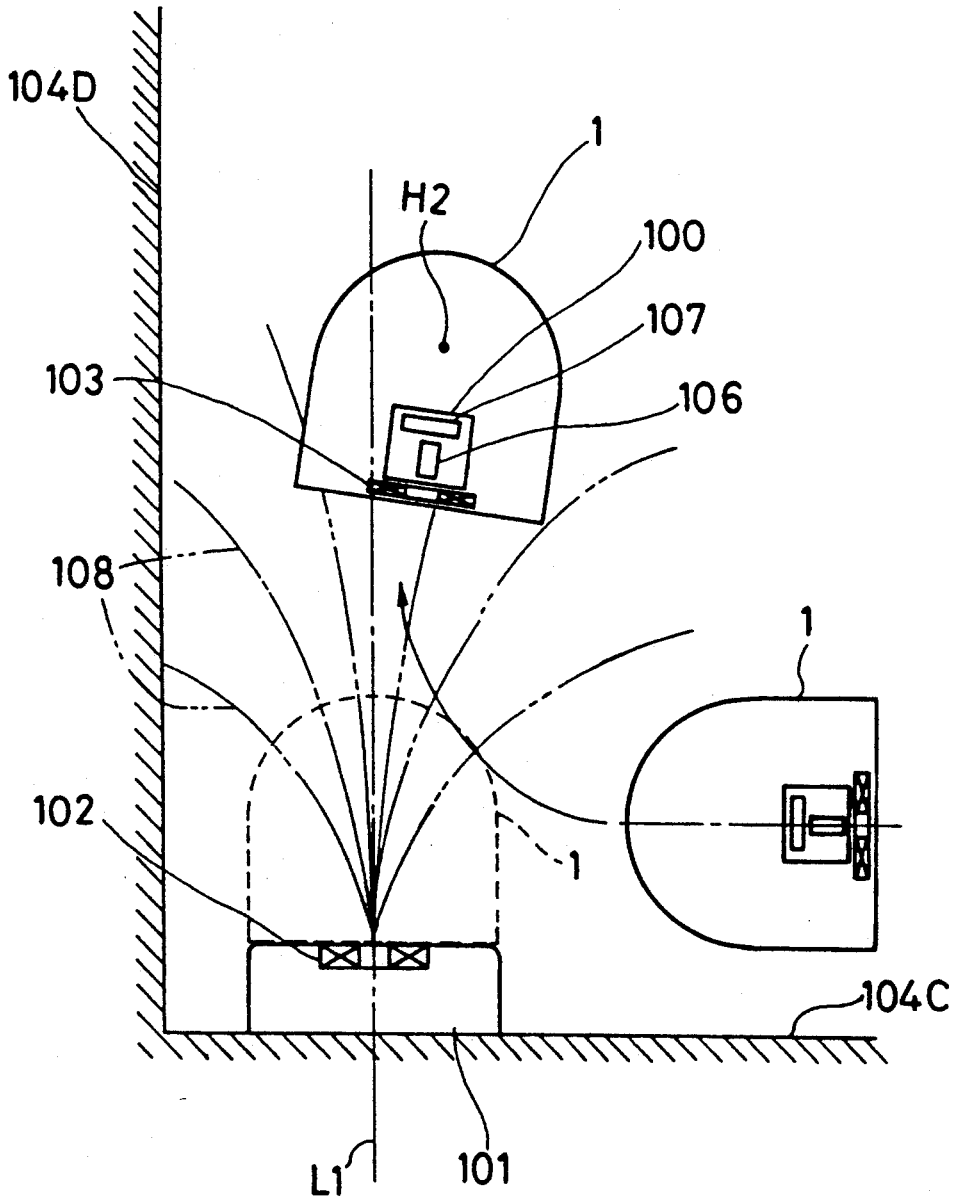
FIG. 8 is a plan view of a path of the cleaning apparatus in the proximity of the starting position.

FIG. 8 is a plan view of the starting position. The search coil 100 of the main body 1 comprises a coil 106 for detecting an intensity of a magnetic field and a coil 107 for detecting a direction of the magnetic field. Guiding the main body 1 to the charger 101 is performed on the basis of the output of the coil 106, and the main body 1 is guided to the charger 101 along the magnetic line 108 of force of the coil 102 in compliance with the output of the coil 107. Since the intensity of the magnetic field of the coil 102 is largest at the part of center line L of the coil 102. The main body 1 is guided on the center line L, and finally arrives at the starting position as shown by dotted line.

Figure 9:
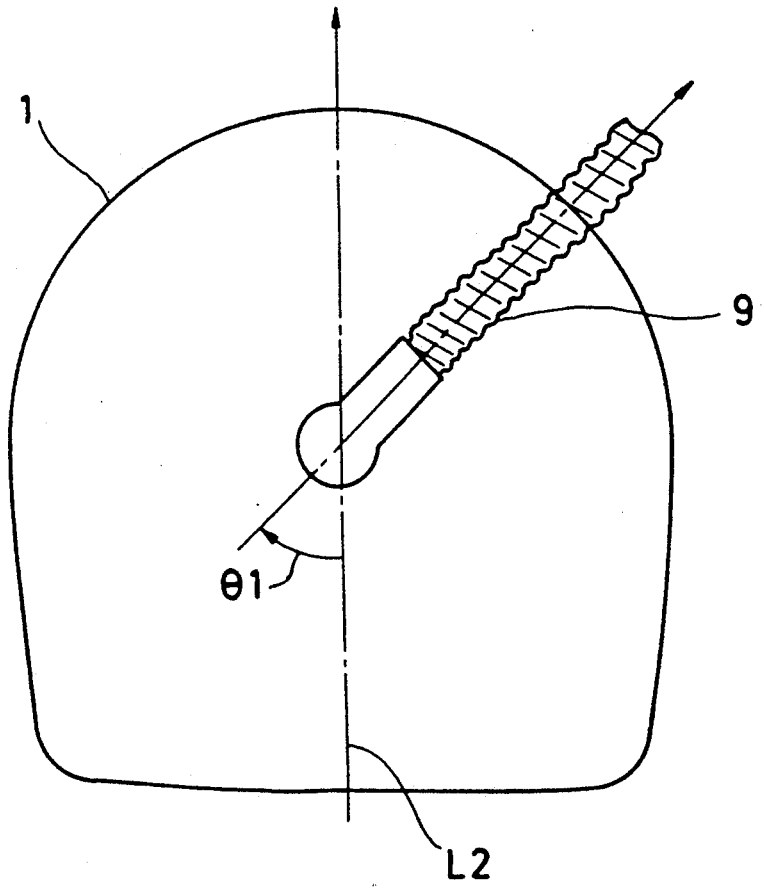
FIG. 9 is a plan view of the embodiment in manual operation.
Figure 10:
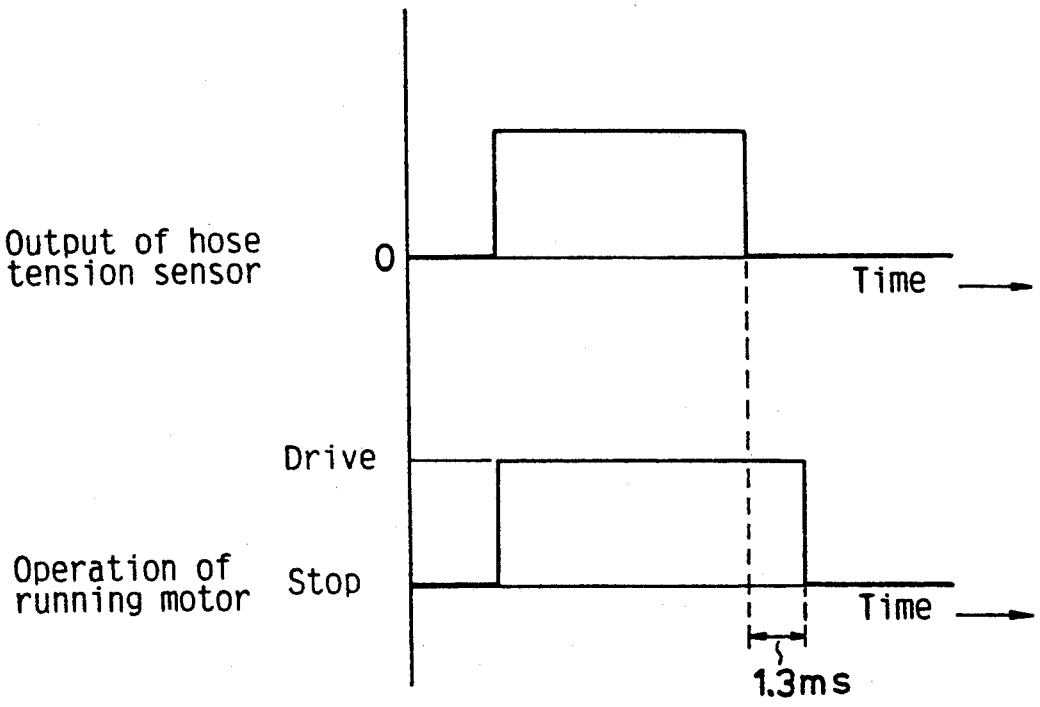
FIG. 10 is a timing chart of the output of a hose tension sensor and operation of a running motor in the manual operation.

A third embodiment of the present invention is described with reference to FIGS. 9-11. Such parts of a room which can not be cleaned by automatic operation of the self-running cleaning apparatus, for example gaps between the furniture and a surfaces of a sofa, is cleaned by manual operation. In the manual operation, the suction hose 9 is coupled to the hose connector 8 of the main body 1. The suction port of the electric fan 2 is switched to the hose connector 8 by the air path changing device 10. The suction hose 9 is provided with a manual switch (not shown) for switching on and off the electric fan 2 in a similar manner of a conventional cleaning apparatus.

In the manual operation, when the suction hose 9 is pulled by an operator and a tension is applied to the hose connector 8, the tension is detected by the hose tension sensor 33. The subprocessor 43 for controlling the running motor receives the detected signal of the hose tension sensor 33 and issues a control signal for driving the moving motor 18. The running motor 18 is rotated while the tension is applied to the hose connector 8 and the detected signal of the hose tension sensor 33 is applied to the subprocessor 43. When the tension is released and the detected signal of the hose tension sensor 33 disappears, the moving motor 18 is driven during the additional short time period of 1.3 ms after disappearance of the detected signal of the hose tension sensor 33 as shown in the timing chart of FIG. 10. The additional short time period of 1.3 ms serves to improve performance of operation in the manual operation. On the other hand, as shown in FIG. 9, the angle of $\theta 1$ of the suction hose 9 with respect to the center line L2 of the main body 1 is detected by the hose direction sensor 32. The detected signal of the hose direction sensor 32 is applied to the subprocessor 44 for controlling the steering motor 23. The subprocessor 44 outputs a control signal to the motor control circuit 49 on the basis of the detected signal of the hose direction sensor 32. Thereby, the steering motor 23 is driven so that the running direction of the main body 1 is equalized to the suction hose direction and hence, the suction hose angle $\theta 1$ soon becomes zero.

As mentioned above, in the manual operation, since the detected signals of the hose direction sensor 32 and the hose tension sensor 33 are directly input to the sub-processors 43 and 44, and moving motor 18 and the steering motor 23 are directly controlled by the sub-processors 43 and 44, respectively, a high speed processing is attainable. Consequently, the operator can be followed by the main body 1 without delay. Hence, a force of the operator for pulling the main body 1 is reduced regardless of a heavy weight of the main body 1. When the main body 1 meets an obstacle, the obstacle is detected by the ultrasonic distance sensor 27 or 28, or the bumper 29, and the main body 1 stops at the position.

Figure 11:
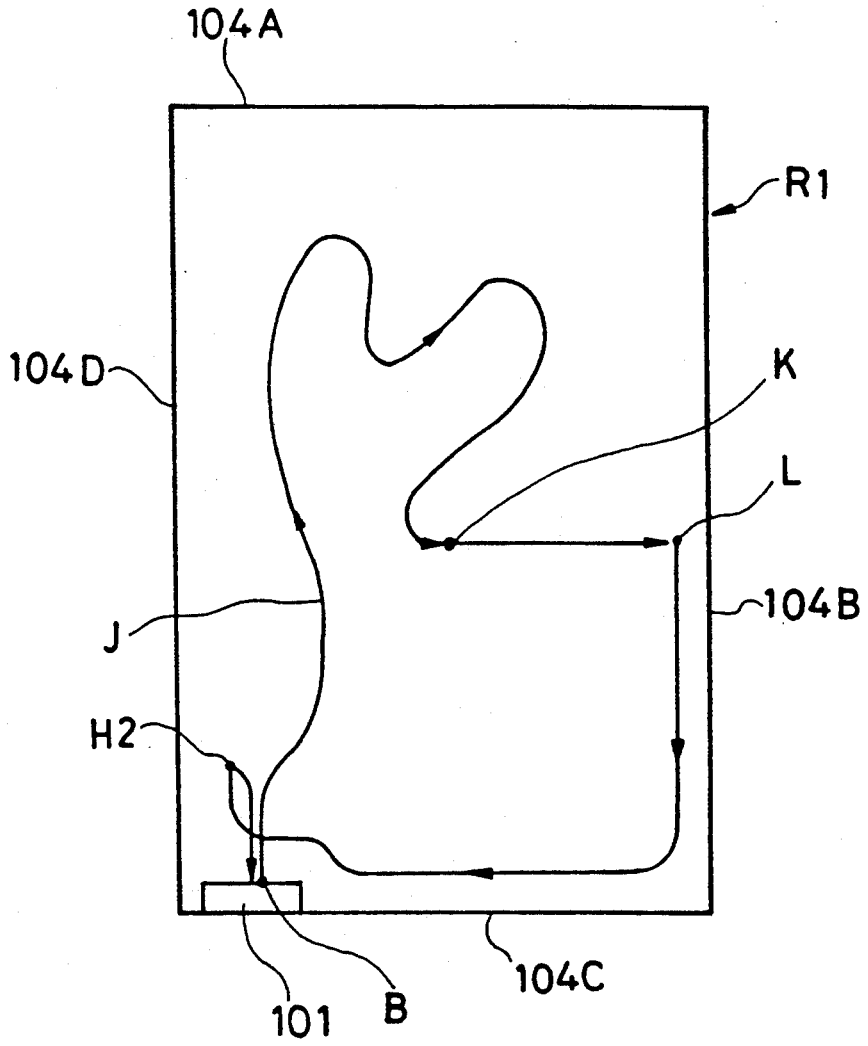
FIG. 11 is a plan view of a path of the cleaning apparatus in manual operation.

FIG. 11 is a plan view of a path of the main body 1 in the above-mentioned manual operation. Referring to FIG. 11, the main body 1 is moved along a path J between the starting position B and a position K by manual operation. When the manual operation finished at the position K, the suction hose 9 is disconnected from the hose connector 8, and the hose connector cover 13 is shifted over the hose connector 8 by manipulating the knob 14. Subsequently, the operation switch 38 of the operation panel 37 is manipulated. The main body 1 runs rightward on the basis of a predetermined program and detects the wall 104 at a position L. At the position L, the main body 1 turns clockwise and runs along the wall 104. Finally the main body 1 is guided to the starting position B in a manner similar to the second embodiment.

Figure 12:
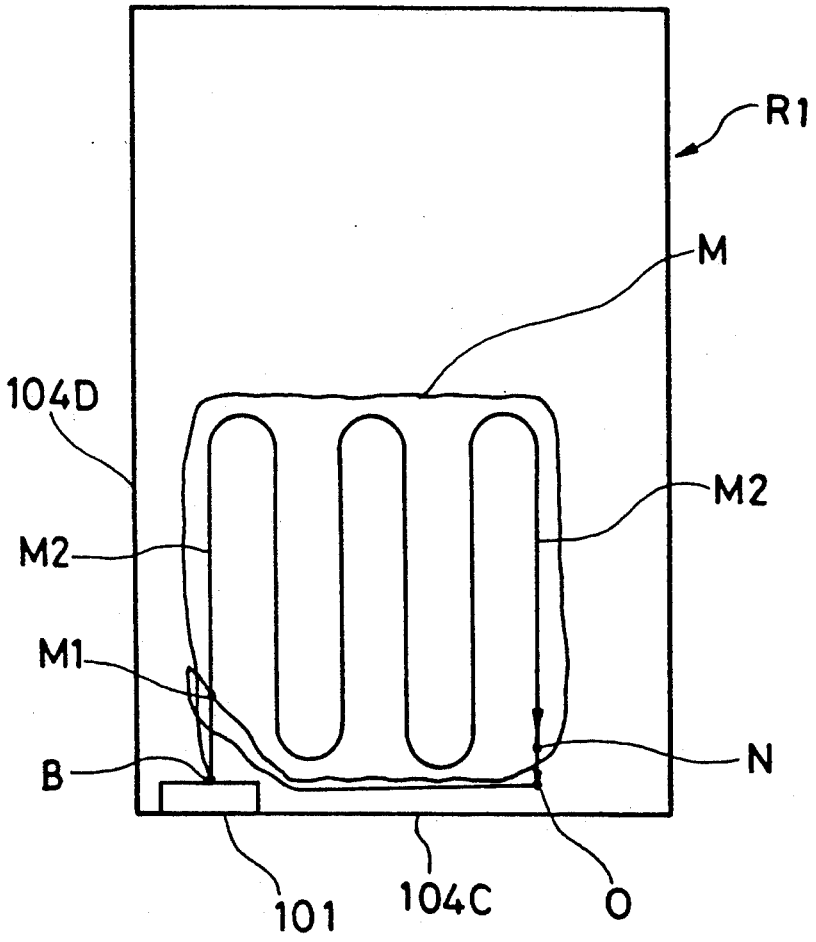
FIG. 12 is a plan view of a path of the cleaning apparatus in manual operation for determining a zone which is cleaned automatically.
Figure 18:
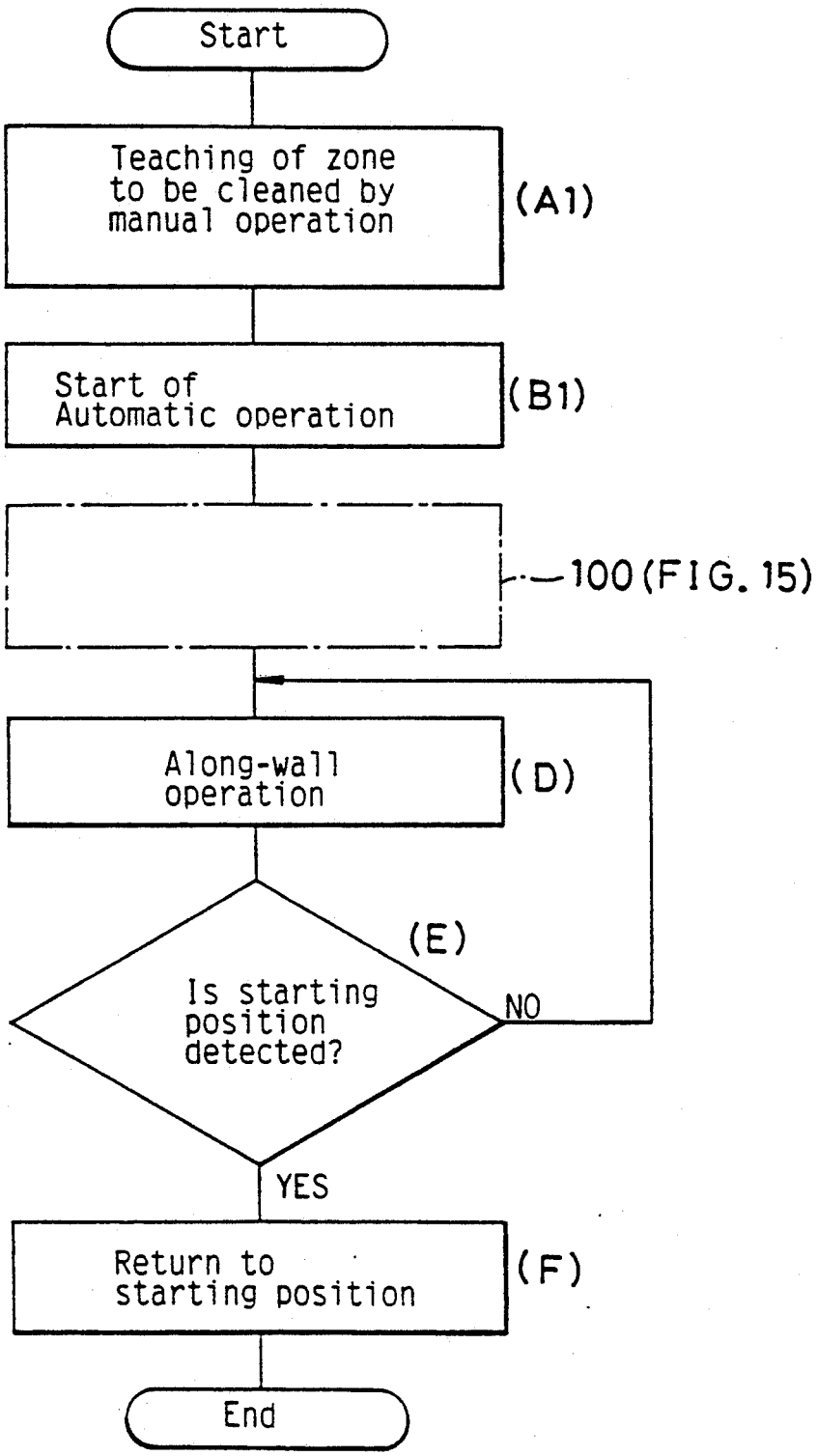
FIG. 18 is a flow chart of a control method of a fourth embodiment.

FIG. 12 is a plan view of a path of the main body 1 in operation of a forth embodiment. In the embodiment, as shown in a flow chart of FIG. 18, a zone to be cleaned is identified by moving the main body 1 on the manual operation (step A1). In the indentifying operation, the suction hose 9 is connected to the suction hose connector 8 and the operation switch 38 is switched to a teaching operation mode. Then the main body 1 is moved along a path M to be cleaned by manual operation. After the manual operation, the main body 1 is placed at a position M1 which is adjacent to the starting position B. Approach of the main body 1 to the starting position B is informed to the operator by beep of the buzzer 39.

By the above-mentioned manual operation, the zone surrounded by the path M is memorized in the memory 52. After then, the suction hose 9 is disconnected from the hose connector 8, and the hose connector 8 is covered by the hose connector cover 13. Subsequently, the operation switch 38 is switched to the automatic operation, and the operation of the main body 1 is started (step B1). The main body 1 runs along the path M2 and cleans the zone surrounded by the path M. The cleaning operation is finished at the position N. Then the main body 1 returns to the starting position B via a position 0 in a similar manner to that described in the second embodiment (step D, E, F).

Although the invention has been described in its preferred form with a certain degree of particularity, it is understood that construction of the present disclosure of the preferred form can be changed and the combination and arrangement of parts may be without departing from the spirit and the scope of the invention as hereinafter claimed.

What is claimed is:

1. A control method, using digital processing means. for automatically operating a self-running cleaning apparatus comprising the steps of:

preparing a block-map of an area to be cleaned by said self-cleaning apparatus, said block-map including a plurality of blocks, wherein said apparatus is initially located on one of said blocks and moves from block to block, cleaning each block said apparatus is on;

storing said block-map;

analyzing, using said digital processing means, a status of said blocks which are positioned to the west, the north, the south and the east of said apparatus;

starting said automatic operation of said apparatus by deciding a moving direction on the basis of a predetermined priority order of directions, said directions corresponding to blocks which are west, north, south and east of said apparatus;

determining blank of a block (n−1, m), when each block in a line and a row of said subdivided area is designated by a combination of one of sequential numbers n−1, n, n+1, and one of sequential numbers m−1, m, m+1;

determining a presence of an obstacle on said block (n−1, m), when said block (n−1, m) is determined to be blank;

determining blank of a block (n, m−1), when said block (n−1, m) is not blank or an obstacle is on said block (n−1, m);

moving to the direction of a block having a first priority, when there is no obstacle on said block (n−1, m);

determining a presence of an obstacle on said block (n, m−1), when said block (n, m−1) is determined to be blank;

moving to the direction of a block having a second priority, when there is no obstacle on said block (n, m−1);

determining blank of a block (n, m+1), when said block (n, m−1) is not blank or an obstacle is on said block (n, m−1);

determining a presence of an obstacle on said block (n, m+1), when said block (n, m+1) is determined to be blank;

moving to the direction of a block having a third priority, when there is no obstacle on said block (n, m+1);

determining blank of a block (n+1, m) when said block (n, m+1) is not blank or an obstacle is on said block (n, m+1);

determining a presence of an obstacle on said block (n+1, m) when said block (n+1, m) is determined to be blank;

moving to the direction of a block having a fourth priority, when there is no obstacle on said block (n+1, m); and moving said apparatus along a wall of said obstacle when said apparatus cannot run through centers of said blocks due to said obstacle being located on said blocks.

2. A control method for a self-running cleaning apparatus in accordance with claim 1, wherein said storing step further comprises the steps of storing a block-map for representing said status of said blocks, wherein said apparatus is moved on the basis of said block-map and said predetermined priority order of directions.

3. A control method for a self-running cleaning apparatus in accordance with claim 2, wherein said storing step further comprises the steps of storing a location of a block which said apparatus has already cleaned in said block-map.

4. A control method, using digital processing means, for automatically operating a self-running cleaning apparatus comprising the steps of:

preparing a block-map of an area to be cleaned by said self-cleaning apparatus, said block-map including a plurality of blocks, wherein said apparatus is initially located on one of said blocks and moves from block to block, cleaning each block said apparatus is on;

storing said block-map;

analyzing, using said digital processing means, a status of said blocks which are positioned to the west, the north, the south and the east of said apparatus, determining blocks on which an obstacle preventing advance of said apparatus is present, determining a direction of movement of said apparatus on the basis of said status of said blocks and a predetermined priority order of directions, said directions corresponding to blocks which are west, north, south and east of said apparatus;

detecting, using detecting means, an obstacle on one of said blocks preventing advancement of said apparatus, moving said apparatus along a wall of said obstacle when said apparatus cannot run through centers of said blocks due to said obstacle being located on said blocks; and directing said apparatus to said initial block after cleaning said area.

5. A control method for a self-running cleaning apparatus in accordance with claim 4, wherein said storing step further comprises the steps of storing a block-map for representing said status of said blocks, wherein said apparatus is moved on the basis of said block-map and said predetermined priority order of directions.

6. A control method for a self-running cleaning apparatus in accordance with claim 5, wherein said storing step further comprises the step of storing a location of a block which said apparatus has already cleaned in said block-map.

7. A control method, using digital processing means, for a self-running cleaning apparatus comprising the steps of:

manually moving said self-running cleaning apparatus from a starting position to an end position along a predetermined path within a zone to be cleaned;

starting an automatic operation of said self-cleaning apparatus;

preparing a block-map of said zone, said block-map including a plurality of blocks, wherein said apparatus is initially located on one of said blocks, and moves from block to block, cleaning each block said apparatus is on, storing a positional representation of said zone surrounding said predetermined path;

analyzing, using said digital processing means, a status of said blocks which are positioned to the west, the north, the south and the east of said apparatus;

determining blocks on which an obstacle preventing advance of said main body is present, determining a direction of movement of said apparatus on the basis of said status of said blocks and a predetermined priority order of directions, said directions corresponding to blocks which are west, north, south and east of said apparatus;

detecting, using detecting means, an obstacle on one of said blocks preventing advancement of said apparatus;

moving said apparatus along a wall of said obstacle when said apparatus cannot run through centers of said blocks due to said obstacle being located on said blocks; and directing said main body to said starting position after cleaning said area.

8. A control method, using digital processing means, for automatically operating a self-running cleaning apparatus initially located at a predetermined position in an area to be cleaned, said method comprising the steps of:

preparing a block-map of said area to be cleaned, said block-map including a plurality of blocks, wherein said predetermined position corresponds to one of said blocks and said apparatus moves from block to block, cleaning each block said apparatus is on;

storing said block-map;

setting a priority order of directions, said directions being north, south, east and west;

for each location block of said plurality of blocks, analyzing, using said digital processing means, all of said blocks which are adjacent to said location block, said location block being one block of said plurality of blocks on which said apparatus is located, said analyzing step including the steps of:

a. detecting, using detecting means, whether each of said adjacent blocks has an obstacle on it or a wall on it;

b. determining whether said apparatus was previously located on each of said adjacent blocks; and c. referring to said priority order of directions;

for each said location block, determining a movement block, said movement block being one of said adjacent blocks that said apparatus determines it will move to next; and controlling movement of said apparatus so that it moves to said movement block.

9. The control method of claim 8, wherein in said analyzing step, if it is detected that there is no obstacle or wall on said adjacent blocks and it is determined that said apparatus was not previously located on said adjacent blocks, determing said movement block based on said priority order of directions.

10. The control method of claim 8, further comprising the step of moving said apparatus to said predetermined position after said area has been cleaned.

11. The control method of claim 8, further comprising the step of storing locations of each said block having a wall or obstacle located on it.

12. The control method of claim 8, further comprising the step of storing locations of each said block on which said apparatus was previously located.

13. A control method, using digital processing means, for automatically operating a self-running cleaning apparatus initially located at a predetermined position in an area to be cleaned, said method comprising the steps of:

manually operating said apparatus on a predetermined path in said area;

preparing a block-map of a remaining portion in said area to be cleaned, said block-map including a plurality of blocks, wherein said predetermined position corresponds to one of said blocks and said apparatus moves from block to block;

setting a priority order of directions, said directions being north, south, east and west;

for each location block of said plurality of blocks, analyzing, using said digital processing means, all of said blocks which are adjacent to said location block, said location block being one block of said plurality of blocks on which said apparatus is located, said analyzing step including the steps of:

a. detecting, using detecting means, whether each of said adjacent blocks has an obstacle on it or a wall on it;

b. determining whether said apparatus was previously located on each of said adjacent blocks; and c. referring to said priority order of directions;

for each said location block, determining a movement block, said movement block being one of said adjacent blocks that said apparatus determines it will move to next; and controlling movement of said apparatus so that it moves to said movement block.

* * * * *